US008753230B2

(12) United States Patent
Stokke et al.

(10) Patent No.: US 8,753,230 B2
(45) Date of Patent: Jun. 17, 2014

(54) CLUB HEAD SETS WITH VARYING CHARACTERISTICS

(75) Inventors: Ryan M. Stokke, Scottsdale, AZ (US); Marty R. Jertson, Cave Creek, AZ (US); Michael R. Nicolette, Scottsdale, AZ (US); John A. Solheim, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 254 days.

(21) Appl. No.: 13/096,944

(22) Filed: Apr. 28, 2011

(65) Prior Publication Data

US 2011/0201444 A1 Aug. 18, 2011

Related U.S. Application Data

(63) Continuation-in-part of application No. 12/791,734, filed on Jun. 1, 2010, which is a continuation-in-part of application No. 11/828,260, filed on Jul. 25, 2007, now abandoned, application No. 13/096,944, which is a continuation-in-part of application No. 12/791,738, filed on Jun. 1, 2010, which is a continuation-in-part of application No. 11/828,260, application No. 13/096,944, which is a continuation-in-part of application No. 12/791,740, filed on Jun. 1, 2010, which is a continuation-in-part of application No. 11/828,260.

(60) Provisional application No. 61/323,349, filed on Apr. 12, 2010, provisional application No. 61/453,904, filed on Mar. 17, 2011.

(51) Int. Cl.
*A63B 53/00* (2006.01)

(52) U.S. Cl.
USPC ..... 473/350; 473/291; D21/749

(58) Field of Classification Search
CPC ..... A63B 53/00
USPC ..... 473/349–350, 290–291, 292; D21/747–752
See application file for complete search history.

(56) References Cited

U.S. PATENT DOCUMENTS

| | | | | |
|---|---|---|---|---|
| D55,278 | S | 5/1920 | Kraeuter | |
| 2,087,685 | A | 7/1937 | Hackney | |
| 3,059,926 | A * | 10/1962 | Johnstone | 473/291 |
| 3,138,386 | A | 6/1964 | Onions | |
| 3,429,576 | A | 2/1969 | Ikeda | |
| 3,845,955 | A | 11/1974 | Solheim | |
| D234,608 | S | 3/1975 | Raymont | |

(Continued)

FOREIGN PATENT DOCUMENTS

| | | |
|---|---|---|
| GB | 2403659 B | 2/2007 |
| JP | 09285576 | 11/1997 |

(Continued)

OTHER PUBLICATIONS

Ralph Maltby, Golf Club Design, Fitting, Alteration, & Repair, Jan. 1995, Ralph Maltby Enterprises, Inc., 4th Edition, p. 508.*

*Primary Examiner* — Gene Kim
*Assistant Examiner* — Matthew B Stanczak

(57) ABSTRACT

Embodiments of golf clubs head sets with varying characteristics are disclosed herein. Other examples and related methods are also generally described herein.

29 Claims, 21 Drawing Sheets

(56) References Cited

U.S. PATENT DOCUMENTS 3,955,820 A 5/1976 Cochran et al.
D240,841 S 8/1976 Solheim
3,979,122 A 9/1976 Belmont
3,995,865 A 12/1976 Cochran et al.
D256,264 S 8/1980 Solheim
4,340,230 A 7/1982 Churchward
4,355,808 A 10/1982 Jernigan et al.
4,420,156 A 12/1983 Campau
D276,644 S 12/1984 Solheim
4,715,601 A 12/1987 Lamanna
4,754,977 A 7/1988 Sahm
4,826,172 A * 5/1989 Antonious ..... 473/350
4,848,747 A 7/1989 Fujimura et al.
4,919,430 A 4/1990 Antonious
4,921,252 A 5/1990 Antonious
4,923,197 A * 5/1990 Schacht ..... 473/291
4,932,658 A 6/1990 Antonious
4,938,470 A * 7/1990 Antonious ..... 473/242
D315,768 S * 3/1991 Antonious ..... D21/749
5,011,151 A 4/1991 Antonious
5,014,993 A * 5/1991 Antonious ..... 473/350
5,026,056 A * 6/1991 McNally et al. ..... 473/291
D319,091 S * 8/1991 Antonious ..... D21/749
D320,056 S * 9/1991 Antonious ..... D21/749
5,048,834 A 9/1991 Gorman
5,048,835 A * 9/1991 Gorman ..... 473/350
5,056,788 A 10/1991 Katayama
D327,308 S * 6/1992 Antonious ..... D21/749
D327,520 S * 6/1992 Antonious ..... D21/749
D327,720 S * 7/1992 Antonious ..... D21/748
D328,116 S * 7/1992 Antonious ..... D21/748
D329,266 S 9/1992 Antonious
D329,904 S * 9/1992 Gorman ..... D21/749
D330,577 S 10/1992 Solheim
D332,478 S 1/1993 Antonious
D332,812 S 1/1993 Solheim
D333,333 S 2/1993 Solheim
5,193,805 A 3/1993 Solheim
D344,778 S 3/1994 Solheim
5,290,032 A * 3/1994 Fenton et al. ..... 473/290
5,295,686 A 3/1994 Lundberg
5,312,105 A 5/1994 Cleveland
5,328,184 A 7/1994 Antonious
5,335,914 A 8/1994 Long
5,356,138 A 10/1994 Chen et al.
5,377,985 A 1/1995 Ohnishi
5,385,348 A 1/1995 Wargo
5,390,924 A 2/1995 Antonious
5,395,113 A 3/1995 Antonious
D357,294 S 4/1995 Solheim
5,413,336 A 5/1995 Iwanaga
5,435,559 A 7/1995 Swisshelm
5,447,307 A * 9/1995 Antonious ..... 473/350
D368,127 S 3/1996 Solheim
5,524,880 A 6/1996 Kobauashi
5,547,188 A 8/1996 Dumontier et al.
5,547,194 A 8/1996 Aizawa et al.
5,547,426 A 8/1996 Wood
5,549,297 A 8/1996 Mahaffey
5,595,552 A * 1/1997 Wright et al. ..... 473/332
D379,393 S 5/1997 Kubica et al.
5,629,475 A 5/1997 Chastonay
5,643,103 A 7/1997 Aizawa
5,643,107 A 7/1997 Gorman
D383,819 S 9/1997 Takahashi et al.
5,665,013 A 9/1997 Kobayashi
5,674,133 A 10/1997 Chang
5,676,605 A 10/1997 Kobayashi
D386,550 S 11/1997 Wright et al.
D386,551 S 11/1997 Solheim et al.
D387,405 S 12/1997 Solheim et al.
D388,486 S 12/1997 Mahaffey
5,695,411 A 12/1997 Wright et al.
D390,617 S 2/1998 Solheim et al.
D392,356 S 3/1998 Burrows
5,792,005 A 8/1998 Sieleman et al.
D398,687 S 9/1998 Miyajima et al.
5,813,919 A 9/1998 Best et al.
5,842,934 A 12/1998 Ezaki et al.
5,873,795 A * 2/1999 Wozny et al. ..... 473/350
D411,272 S 6/1999 Burrows
5,921,869 A 7/1999 Blough et al.
5,971,868 A 10/1999 Kosmatka
5,984,803 A 11/1999 Chappel
D418,184 S 12/1999 Kubica
6,015,354 A 1/2000 Ahn et al.
6,027,415 A 2/2000 Takeda
D421,784 S 3/2000 Kubica
D422,043 S 3/2000 Kubica et al.
6,077,171 A 6/2000 Yoneyama
6,077,173 A 6/2000 Stites
D428,634 S * 7/2000 Nagai et al. ..... D21/759
D428,635 S 7/2000 Nagai et al.
D429,298 S 8/2000 Butler
D429,299 S 8/2000 Kubica et al.
D437,902 S 2/2001 Persinger
D437,906 S 2/2001 Gilbert
6,183,376 B1 2/2001 Peters et al.
6,206,790 B1 3/2001 Kubica et al.
6,210,290 B1 * 4/2001 Erickson et al. ..... 473/345
D442,659 S 5/2001 Kubica et al.
D443,008 S 5/2001 Kubica et al.
D444,195 S * 6/2001 Wahl et al. ..... D21/748
D445,157 S 7/2001 Jones et al.
6,280,348 B1 * 8/2001 Stites ..... 473/334
6,290,607 B1 9/2001 Gilbert et al.
6,290,608 B2 * 9/2001 Gates ..... 473/292
D453,949 S 2/2002 Helmstetter et al.
D456,056 S 4/2002 Bakke
6,379,262 B1 * 4/2002 Boone ..... 473/324
D458,328 S 6/2002 Solheim et al.
6,450,897 B2 * 9/2002 Stites et al. ..... 473/334
6,454,665 B2 * 9/2002 Antonious ..... 473/346
D465,253 S 11/2002 Best
6,482,104 B1 11/2002 Gilbert
D473,605 S 4/2003 Petersen et al.
D475,108 S 5/2003 Madore
D476,708 S * 7/2003 Wahl et al. ..... D21/747
6,592,469 B2 7/2003 Gilbert
6,595,870 B2 7/2003 Stites et al.
6,599,202 B2 7/2003 Miyamoto
D480,440 S 10/2003 Rollinson et al.
6,695,714 B1 2/2004 Bliss et al.
6,709,345 B2 3/2004 Iwata et al.
D489,106 S * 4/2004 Wahl et al. ..... D21/749
D492,376 S 6/2004 Nicolette et al.
D494,240 S 8/2004 Schweigert
D494,648 S 8/2004 Schweigert et al.
6,776,723 B2 8/2004 Bliss et al.
D496,973 S * 10/2004 Wahl et al. ..... D21/749
6,811,496 B2 11/2004 Wahl et al.
D500,350 S 12/2004 Schweigert et al.
D500,351 S 12/2004 Schweigert et al.
6,830,519 B2 12/2004 Reed et al.
6,832,962 B2 12/2004 Stites et al.
D501,035 S * 1/2005 Wahl et al. ..... D21/747
D502,237 S 2/2005 Schweigert et al.
6,855,066 B2 2/2005 Best
D502,975 S 3/2005 Schweigert et al.
D503,204 S 3/2005 Nicolette et al.
6,860,819 B2 3/2005 Gilbert
6,881,158 B2 4/2005 Yang
D504,925 S 5/2005 Schweigert et al.
D505,171 S 5/2005 Schweigert et al.
D507,614 S 7/2005 Schweigert et al.
6,921,344 B2 7/2005 Gilbert et al.
D508,099 S 8/2005 Schweigert et al.
6,929,563 B2 8/2005 Nishitani
6,935,967 B2 8/2005 Mahaffey et al.
D510,115 S 9/2005 Lang et al.
6,962,538 B2 11/2005 Roach et al.
D512,757 S 12/2005 Cleveland et al.
D513,423 S 1/2006 Best et al.
D514,183 S 1/2006 Schweigert et al.

(56) References Cited

U.S. PATENT DOCUMENTS 6,984,180 B2 1/2006 Hasebe
6,991,559 B2 1/2006 Yabu
D516,152 S 2/2006 Madore
D517,625 S 3/2006 Sanchez et al.
D518,538 S 4/2006 Ines et al.
D519,179 S 4/2006 Roberts et al.
7,022,028 B2 4/2006 Nagai et al.
D523,501 S 6/2006 Nicolette et al.
D525,330 S 7/2006 Imamoto
7,083,530 B2 8/2006 Wahl et al.
D528,617 S 9/2006 Imamoto
D530,759 S 10/2006 Nicolette et al.
D530,760 S 10/2006 Schweigert et al.
7,125,343 B2 10/2006 Imamoto
D531,688 S 11/2006 Frame et al.
D532,849 S 11/2006 Nicolette et al.
7,131,913 B2 11/2006 Iwata et al.
D534,228 S 12/2006 Nicolette et al.
7,147,571 B2 12/2006 Best et al.
D534,595 S 1/2007 Hasebe
D534,597 S 1/2007 Nicolette et al.
D536,759 S 2/2007 Schweigert et al.
D537,494 S 2/2007 Jertson et al.
D538,366 S 3/2007 Nicolette et al.
7,186,188 B2 3/2007 Gilbert et al.
D539,862 S 4/2007 Nunez et al.
D539,863 S 4/2007 Nunez et al.
D539,864 S 4/2007 Nicolette et al.
D540,898 S 4/2007 Solheim et al.
D541,360 S 4/2007 Schweigert et al.
7,207,900 B2 4/2007 Nicolette et al.
D544,056 S 6/2007 Nicolette et al.
7,235,023 B2 6/2007 Sugimoto
D547,410 S 7/2007 Nicolette et al.
7,238,119 B2 7/2007 Roach et al.
7,244,188 B2 7/2007 Best
D550,316 S * 9/2007 Nagai et al. ..... D21/759
D554,212 S 10/2007 Nunez et al.
D554,217 S 10/2007 Ruggiero et al.
D554,218 S * 10/2007 Ruggiero et al. ..... D21/759
7,281,991 B2 10/2007 Gilbert et al.
D557,502 S 12/2007 Quartarone et al.
D559,931 S 1/2008 Roach et al.
D561,855 S 2/2008 Schweigert et al.
D562,423 S 2/2008 Foster et al.
D562,925 S 2/2008 Schweigert et al.
D566,803 S 4/2008 Foster et al.
7,371,190 B2 5/2008 Gilbert et al.
D570,435 S 6/2008 Sanchez et al.
D570,935 S 6/2008 Schweigert et al.
D570,936 S 6/2008 Schweigert et al.
D571,422 S 6/2008 Schweigert et al.
D571,881 S 6/2008 Nicolette et al.
7,390,270 B2 6/2008 Roberts et al.
D572,326 S 7/2008 Schweigert et al.
D572,329 S 7/2008 Nicolette et al.
D573,219 S 7/2008 Schweigert et al.
7,396,299 B2 7/2008 Nicolette et al.
7,399,238 B2 7/2008 Hocknell et al.
D577,783 S 9/2008 Schweigert et al.
D578,590 S 10/2008 Schweigert et al.
D580,503 S 11/2008 Roach et al.
D581,000 S 11/2008 Nicolette et al.
D585,951 S * 2/2009 Kohno ..... D21/759
7,507,167 B2 3/2009 Roach et al.
D595,797 S 7/2009 Oldknow
D596,256 S 7/2009 Schweigert et al.
D596,257 S 7/2009 Jertson et al.
D597,157 S 7/2009 Wallin et al.
D597,158 S 7/2009 Schweigert et al.
D598,060 S 8/2009 Barez et al.
D601,216 S 9/2009 Jertson et al.
D602,103 S 10/2009 Jorgensen et al.
D604,783 S 11/2009 Nicolette et al.
D607,073 S 12/2009 Jertson et al.
7,749,102 B2 * 7/2010 Nakamura ..... 473/342
D621,893 S 8/2010 Nicolette et al.
D621,894 S 8/2010 Schweigert
D621,895 S 8/2010 Schweigert et al.
7,789,771 B2 9/2010 Park et al.
7,789,772 B2 9/2010 Sukman
7,803,064 B2 9/2010 Roach et al.
D627,410 S 11/2010 Nicolette et al.
7,833,110 B2 11/2010 Nakamura
D635,627 S 4/2011 Nicolette
7,935,000 B2 5/2011 Stites
D642,642 S 8/2011 Jertson et al.
D643,491 S 8/2011 Stokke et al.
D643,492 S 8/2011 Nicolette et al.
D643,896 S 8/2011 Jertson et al.
8,021,246 B2 * 9/2011 Llewellyn et al. ..... 473/332
D647,582 S 10/2011 Nicolette et al.
8,202,174 B2 6/2012 Breier et al.
8,277,337 B2 10/2012 Shimazaki
8,353,784 B2 1/2013 Boyd et al.
8,403,774 B2 3/2013 Stites
8,435,132 B2 * 5/2013 Oldknow et al. ..... 473/291
8,506,423 B2 8/2013 Oldknow et al.
8,657,700 B2 2/2014 Nicolette et al.
2001/0001774 A1 * 5/2001 Antonious ..... 473/349
2001/0007834 A1 * 7/2001 Gates ..... 473/292
2001/0014628 A1 * 8/2001 Erickson et al. ..... 473/334
2001/0044345 A1 11/2001 Stites et al.
2001/0055996 A1 12/2001 Iwata et al.
2002/0098910 A1 7/2002 Gilbert
2002/0128088 A1 9/2002 Yializis et al.
2002/0173376 A1 * 11/2002 Stites et al. ..... 473/334
2003/0092499 A1 5/2003 Gilbert
2003/0092502 A1 5/2003 Pergande et al.
2003/0119602 A1 6/2003 Kennedy, III et al.
2003/0134687 A1 7/2003 Truesdale
2003/0139222 A1 7/2003 Vadersen
2003/0199331 A1 * 10/2003 Stites, III ..... 473/290
2003/0228928 A1 12/2003 Yabu
2004/0018890 A1 * 1/2004 Stites et al. ..... 473/346
2004/0147335 A1 7/2004 Iwata et al.
2005/0003900 A1 1/2005 Sugimoto
2005/0009632 A1 1/2005 Schweigert et al.
2005/0020377 A1 1/2005 Yang et al.
2005/0026716 A1 2/2005 Wahl et al.
2005/0064951 A1 3/2005 Stites et al.
2005/0096156 A1 5/2005 Chen
2005/0137024 A1 6/2005 Stites et al.
2005/0202899 A1 9/2005 Roach et al.
2005/0239572 A1 10/2005 Roach et al.
2005/0245325 A1 11/2005 Gilbert et al.
2005/0266932 A1 12/2005 Roach et al.
2006/0100033 A1 5/2006 Nelson et al.
2006/0166758 A1 7/2006 Roberts et al.
2006/0234811 A1 10/2006 Gilbert et al.
2006/0258480 A1 11/2006 Hou
2007/0117653 A1 * 5/2007 Yoneyama ..... 473/350
2007/0155534 A1 7/2007 Tsai et al.
2007/0225084 A1 9/2007 Schweigert et al.
2007/0281796 A1 12/2007 Gilbert et al.
2008/0045353 A1 2/2008 Lo et al.
2008/0051220 A1 2/2008 Soracco et al.
2008/0058113 A1 3/2008 Nicolette et al.
2008/0242444 A1 10/2008 Park et al.
2008/0300065 A1 12/2008 Schweigert
2009/0029790 A1 1/2009 Nicolette et al.
2009/0029791 A1 1/2009 Solheim
2009/0149272 A1 6/2009 Roach et al.
2009/0149277 A1 6/2009 Deng et al.
2009/0275421 A1 11/2009 Gilbert et al.
2010/0160067 A1 6/2010 Llewellyn et al.
2010/0173724 A1 7/2010 Stites et al.
2010/0178999 A1 7/2010 Nicolette et al.
2010/0255923 A1 * 10/2010 Stites ..... 473/226
2010/0267461 A1 10/2010 Stites
2010/0267463 A1 * 10/2010 Stites ..... 473/291
2010/0279794 A1 11/2010 Nicolette et al.
2010/0279795 A1 11/2010 Nicolette et al.
2010/0279796 A1 11/2010 Nicolette et al.

(56) References Cited

U.S. PATENT DOCUMENTS

| | | | |
|---|---|---|---|
| 2011/0009205 | A1 | 1/2011 | Oldknow et al. |
| 2011/0021285 | A1 | 1/2011 | Shimazaki |
| 2011/0124432 | A1 | 5/2011 | Oldknow et al. |
| 2011/0201444 | A1 | 8/2011 | Stokke et al. |
| 2011/0207544 | A1 | 8/2011 | Stites |
| 2011/0207551 | A1 | 8/2011 | Breier et al. |
| 2012/0289360 | A1 | 11/2012 | Breier et al. |
| 2013/0109500 | A1 | 5/2013 | Boyd et al. |
| 2013/0116064 | A1 | 5/2013 | Park et al. |
| 2013/0130827 | A1 | 5/2013 | Boyd et al. |

FOREIGN PATENT DOCUMENTS

| | | |
|---|---|---|
| JP | 10201883 | 8/1998 |
| JP | 10277186 A | 10/1998 |
| JP | 200189545 | 7/2000 |

* cited by examiner

CLUB HEAD SETS WITH VARYING CHARACTERISTICS

CROSS-REFERENCE TO RELATED APPLICATIONS

This patent application is a continuation-in-part application claiming priority to U.S. patent application Ser. No. 12/791,734, filed on Jun. 1, 2010, to U.S. patent application Ser. No. 12/791,738, filed on Jun. 1, 2010, and to U.S. patent application Ser. No. 12/791,740, filed on Jun. 1, 2010, each of which are non-provisional patent applications claiming priority to U.S. Provisional Patent Application No. 61/323,349, filed on Apr. 12, 2010, and each of which are continuation-in-part applications claiming priority to U.S. patent application Ser. No. 11/828,260, filed on Jul. 25, 2007. This patent application also claims priority to U.S. Provisional Patent Application No. 61/453,904, filed on Mar. 17, 2011.

The disclosures of the referenced applications are incorporated herein by reference.

TECHNICAL FIELD

This disclosure relates generally to sports equipment, and relates more particularly to club heads and related methods.

BACKGROUND

Golf clubs and specifically golf club heads of various designs have typically been developed to improve a person's golf swing and resulting golf shot. In particular, many people are unable to hit or lack consistency when hitting "down" on a ball, that is, to regularly hit the ball squarely. Golf club designs and, particularly, golf club head designs may optimize a golf club head's weighting scheme, such as the golf club head's center of gravity position and moments of inertia. Such designs may mitigate a person's inconsistency problems. Back weighting and/or an additional lower toe weighting may strategically position the center of gravity and may induce the person during his swing to hit "down" on the ball, thus, hitting the ball squarely.

Figure 1:
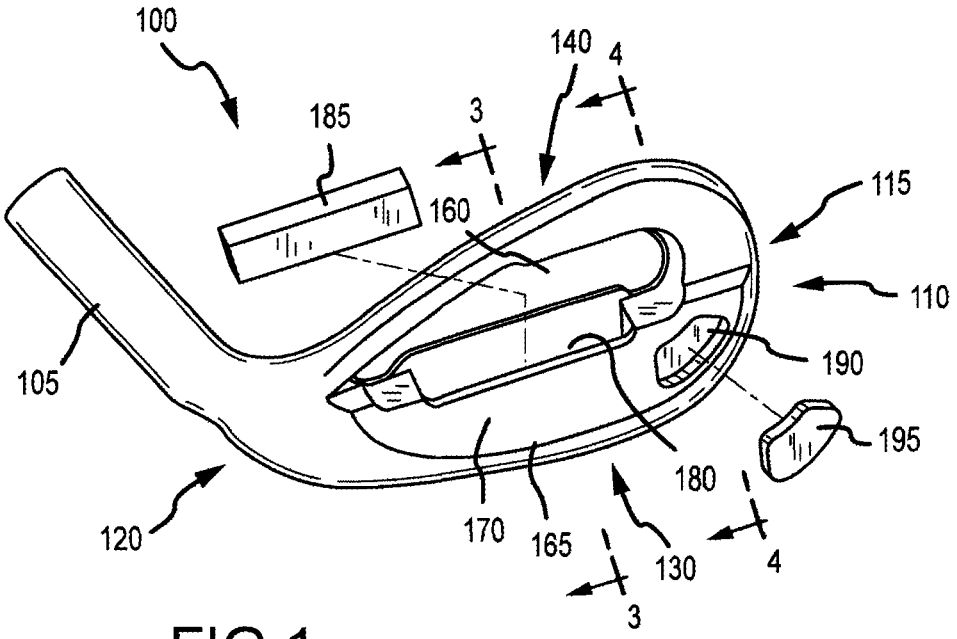
FIG. 1 illustrates an exploded view of an exemplary golf club head according to an embodiment of the golf clubs and methods of manufacture described herein.

For simplicity and clarity of illustration, the drawing figures illustrate the general manner of construction, and descriptions and details of well-known features and techniques may be omitted to avoid unnecessarily obscuring the golf clubs and their methods of manufacture. Additionally, elements in the drawing figures are not necessarily drawn to scale. For example, the dimensions of some of the elements in the figures may be exaggerated relative to other elements to help improve understanding of embodiments of the golf clubs and their methods of manufacture. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of golf clubs and methods of manufacture described herein are, for example, capable of operation in sequences other than those illustrated or otherwise described herein. Furthermore, the terms "contain," "include," and "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The terms "left," "right," "front," "back," "top," "bottom," "side," "under," "over," and the like in the description and in the claims, if any, are used for descriptive purposes and not necessarily for describing permanent relative positions. It is to be understood that the terms so used are interchangeable under appropriate circumstances such that the embodiments of golf clubs and methods of manufacture described herein are, for example, capable of operation in other orientations than those illustrated or otherwise described herein. The term "coupled," as used herein, is defined as directly or indirectly connected in an electrical, physical, mechanical, or other manner.

DESCRIPTION

In one embodiment of the golf clubs and methods of manufacture described herein, a golf club head comprises a body having a toe region, a heel region opposite the toe region, a sole region, and a top region opposite the sole region. The golf club head further comprises a front face, a first back opposite the front face, a second back opposite the front face and extending farther from the front face than the first back. The second back extends from the heel region to the toe region, and extends from the sole region to about a midpoint between the sole region and the top region. The golf cub head further comprises a first cavity between the first back and the second back, and a second cavity integral with the second back at the toe region. This embodiment may further comprise a first weight that is inserted in the first cavity and a second weight inserted in the second cavity.

In another embodiment of golf clubs and methods of manufacture, a golf club head comprises a body comprising a front face, a heel region, a toe region opposite the heel region, and a sole. The sole extends from the heel region to the toe region, and the sole extends from the front face to a back sole edge. The golf club head further comprises a top opposite the sole, and a first back opposite the front face and substantially parallel to the front face. The first back extends from the heel region to the toe region, and extends from a midpoint between the sole and the top, to the top. The golf club head further comprises a second back opposite the front face extending from the back sole edge to about the midpoint. The golf club head further comprises a rectangular first cavity between the second back and the front face, and a second cavity integral with the second back at the toe region. This embodiment may further comprise a first weight that is inserted in the first cavity and a second weight inserted in the second cavity.

In another embodiment of golf clubs and methods of manufacture, a golf club comprises a golf club head described herein and coupled to a shaft. The golf club further comprises a hosel ratio of 0.75 wherein, the hosel ratio comprises a hosel distance to a front face distance. The hosel distance extends from a point at the heel region to a second end opposite the first end, and the front face distance comprises a distance measured along the front face from the point to a toe edge and substantially parallel to the sole. The golf club may further comprise a first weight to occupy the first cavity and a second weight to occupy the second cavity.

In an embodiment of golf clubs and methods of manufacture, a method for manufacturing a golf club head comprises providing a body having a toe region, a heel region opposite the toe region, a sole region, and a top region opposite the sole region. This embodiment further comprises a front face, a first back opposite the front face, a second back opposite the front face and extending farther from the front face than the first back. The second back extends from the heel region to the toe region, and extends from the sole region to about a midpoint between the sole region and the top region. The body is further provided to comprise a first cavity between the first back and the second back, and a second cavity integral with the second back at the toe region. This embodiment may further comprise providing a first weight that is inserted in the first cavity and providing a second weight inserted in the second cavity.

There can be examples in accordance with the present disclosure where a club head set can comprise two or more club heads, each comprising a loft angle, a front face, a back face opposite the front face, and one or more support bars protruded from the back face. The loft angle can be incrementally varied across the two or more club heads, and a characteristic of the one or more support bars is incrementally varied across the two or more club heads as the loft angle is incrementally varied across the two or more club heads.

There also can be examples in accordance with the present disclosure where a club head set can comprise first and second club heads. The first club head can comprise a first loft angle, a first front face, and a first back portion comprising a first heel region, a first toe region, a first back face opposite the first front face and extended between the first heel and toe regions, and one or more first support bars coupled to the first back face. The second club head can comprise a second loft angle, a second front face, and a second back portion comprising a second heel region, a second toe region, a second back face opposite the second front face and extended between the second head and toe regions, and one or more second support bars coupled to the second back face. In such examples, the first loft angle is greater than the second loft angle, and an attribute of the one or more first support bars is greater than an attribute of the one or more second support bars.

There also can be examples in accordance with the present disclosure where a method can comprise providing a club head set. Providing the club head set can comprise providing a first club head, the first club head comprising a first loft angle, a first front face, and a first back portion comprising, a first heel region, a first toe region, a first back face opposite the first front face and extended between the first heel and toe regions, and one or more first support bars coupled to the first back face, the one or more first support bars comprising a first support bar characteristic. Providing the club head set can also comprise providing a second club head, the second club head comprising a second loft angle, a second front face and a second back portion comprising a second heel region, a second toe region, a second back face opposite the second front face and extended between the second heel and toe regions, and one or more second support bars coupled to the second back face, the one or more second support bars comprising a second support bar characteristic. In such examples, providing the first club head comprises providing the first loft angle to be greater than the second loft angle, and providing the first support bar characteristic to be greater than the second support bar characteristic.

There also can be examples in accordance with the present disclosure where a club head set can comprise two or more club heads, each comprising a loft angle, a front face, and a backside comprising a back face opposite the front face, and a weight located only at a lower toe section of the backside. In such examples, the loft angle can be varied across the two or more club heads, a first characteristic of the weight can be varied across the two or more club heads, a second characteristic of the weight can be varied across the two or more club heads, and the first and second characteristics can be inversely varied relative to each other.

There also can be examples in accordance with the present disclosure where a club head set can comprise first and second club heads. The first club head can comprise a first loft angle, a first front face, and a first back portion that comprises a first heel region, a first toe region comprising a first lower toe section, and a first back face opposite the first front face and extended between the first heel and first toe regions. The second club head can comprise a second loft angle, a second front face, and a second back portion that comprises a second heel region, a second toe region comprising a second lower toe section, and a second back face opposite the second front face and extended between the second heel and second toe regions. The first club head can also comprise a first weight at the first lower toe section of the first toe region, and the second club head can also comprise a second weight at the second lower toe section of the second toe region. In such examples, the first loft angle can be greater than the second loft angle, the first and second weights can comprise substantially similar masses, the first and second weights each comprise first dimensions corresponding to each other, and the first and second weights each comprise second dimensions corresponding to each other. When the first dimension of the first weight is greater than the first dimension of the second weight, the second dimension of the second weight can be greater than the second dimension of the first weight. When the second dimension of the first weight is greater than the second dimension of the second weight, the first dimension of the second weight can be greater than the first dimension of the first weight.

There also can be examples in accordance with the present disclosure where a method can comprise providing a club head set. Providing the club head set can comprise providing a first club head of the club head set, and providing a second club head of the club head set. The first club head can comprise a first loft angle, a first front face, and a first back portion comprising a first back face opposite the first front face and extended between heel and toe regions of the first back portion and a first lower toe section comprising a first cavity. The second club head can comprise a second loft angle, a second front face, and a second back portion comprising a second back face opposite the second front face and extended between heel and toe regions of the second back portion, and a second lower toe section comprising a second cavity. Providing the first club head can comprise providing a first weight at the first cavity, and providing the first loft angle to be greater than the second loft angle. Providing the second club head can comprise providing a second weight at the second cavity. Providing the first weight can comprise providing a first length, a first width, and a first depth of the first weight. Providing the second weight can comprises providing a second length and a second width of the second weight such that at least one of the second length of the second weight is greater than the first length of the first weight, or the second width of the second weight is greater than the first width of the first weight. Providing the second weight can also comprise providing a second depth of the second weight such that the first depth of the first weight is greater than the second depth of the second weight.

There also can be examples in accordance with the present disclosure where a golf club head can comprise a front face and a back portion. The back portion can comprise a heel region, a toe region, a center region between the heel and toe regions, a back end extended between the heel and toe regions, and a cavity. The cavity can comprise a cavity heel zone, a cavity toe zone, a cavity center zone between the cavity heel and toe zones, a cavity inner section located towards the front face, and a cavity outer section located towards the back end. The cavity can be wider at the cavity center zone than at the cavity heel and toe zones.

There also can be examples in accordance with the present disclosure where a method can comprise providing an insert for a golf club head and/or providing a body of a club head. Providing the insert can comprise providing insert heel and toe zones, and providing an insert center zone between the insert heel and toe zones that is thicker than the insert heel and toe zones. Providing the body can comprise providing a back face and a back end at a back portion of the body, and providing a cavity between the back face and the back end. The cavity can comprise a cavity inner section adjacent to the back face, a cavity outer section opposite the back end, cavity heel and toe zones, and a cavity center zone between the cavity heel and toe zones that is thicker than the cavity heel and toe zones. The insert can be provided to be at least partially housed in the cavity.

There also can be examples in accordance with the present disclosure where a golf club head can comprise a back portion of a body of the club head, and an insert. The back portion can comprise a heel region, a toe region, a center region between the heel and toe regions, a back surface opposite the front face and extended between the heel and toe regions, a back wall extended between the heel and toe regions, and a cavity located between the back surface and the back wall. The cavity can comprise a cavity heel zone, a cavity toe zone, a cavity center zone between the cavity heel and toe zones, a cavity inner wall comprising a portion of the back surface, and a cavity outer wall located opposite the back wall. The insert can comprise an insert heel zone, an insert toe zone, an insert center zone between the insert heel and toe zones, an insert inner wall complementary to the cavity inner wall, and an insert outer wall complementary to the cavity outer wall. The golf club head can comprise a moment of inertia about the center region. The insert can be configured to be at least partially housed in the cavity. The cavity can be wider, from the cavity inner wall to the cavity outer wall, at the cavity center zone than at the cavity heel and toe zones. The insert can be wider, from the insert inner wall to the insert outer wall, at the insert center zone than at the insert heel and toe zones. A distribution of mass of the cavity inner wall can be concentrated at the cavity center zone. A distribution of mass of the insert can be shifted away from the insert heel and toe zones and towards the insert center zone. A density of a body of the golf club head can be greater than a density of the insert. A first portion of the moment of inertia contributed by the body of the club head at the cavity heel and toe zones can be greater than a second portion of the moment of inertia contributed by the insert at the insert heel and toe zones. The insert heel and toe zones can be obtusely angled relative to each other about the insert center zone and along the insert inner wall. The cavity inner wall can be obtusely angled complementarily to the insert inner wall. The insert can comprise a grip portion to aid during removal of the insert from the cavity, where the grip portion can be configured to remain external to the cavity when the insert is housed in the cavity.

There also can be examples in accordance with the present disclosure where a golf club head set can comprise a first club head comprising a first strike face, a first back face opposite the first strike face, a first top end, a first bottom end opposite the first top end, a first toe end, a first toe region comprising the first toe end, a first heel end opposite the first toe end, a first heel region comprising the first heel end, and a first vertical axis extended substantially perpendicularly through the first top end and the first bottom ends, and extended between the first heel and first toe regions. The first back face can comprise a first cavity located at the toe region and comprising a first cavity base and a first cavity wall bounding at least a portion of the first cavity base. The first back face can also comprise a first bar comprising a first bar axis extending along a length of the first bar. The first bar can be protruded from the first cavity base and extend diagonally, relative to the first vertical axis, across at least a first portion of the first cavity. The first bar axis can intersect the first vertical axis and extend therefrom towards the first toe end and the first top end.

There also can be examples in accordance with the present disclosure where a golf club head set can comprise a first club head comprising a first strike face, a first back face opposite the first strike face, a first top end, a first bottom end opposite the first top end, a first toe end, a first toe region comprising the first toe end, a first heel end opposite the first toe end, a first heel region comprising the first heel end, and a first vertical axis extended substantially perpendicularly through the first top end and the first bottom end and extended between the first heel region and the first toe region. The first back face can comprise a first cavity located at the toe region and comprising a first cavity base and a first cavity wall bounding the first cavity base. The first back face can also comprise a first bar protruded from the first cavity base, angled at a first bar angle relative to the first vertical axis, and extending across the first cavity. The first back face can also comprise a first hourglass support protruded from the first back face and comprising top and bottom portions a middle portion narrower than the top and bottom portions, and heel and toe sidewalls defining the top, middle, and bottom portions of the first hourglass support therebetween. The toe sidewall of the first hourglass support can protrude above the first cavity base. The first cavity wall can comprise the toe sidewall of the first hourglass support.

There also can be examples in accordance with the present disclosure where a method for providing a golf club head set can comprise providing a first club head of one or more club heads comprising diagonal stabilizing bars. A first vertical axis can extend through a first top end and a first bottom end of the first club head, and between a first heel region and a first toe region of the first club head. Providing the first club head can comprise providing a first back face opposite a first strike face of the first club head, providing a first cavity at the first back face and the first toe region, and providing a first bar within and protruded from the first cavity. The first bar can comprise a first bar axis extending along a length of the first bar. The diagonal stabilizing bars of the one or more club heads can comprise the first bar. Providing the first cavity can comprise providing a first cavity base, and providing a first cavity wall bounding the first cavity base. Providing the first bar can comprise aligning the first bar diagonally at a first bar angle relative to the first vertical axis such that the first bar axis intersects the first vertical axis and extends therefrom towards a first toe end and the first top end of the first club head.

Other examples and embodiments are further disclosed herein. Such examples and embodiments may be found in the figures, in the claims, and/or in the description of the present application.

Figure 2:
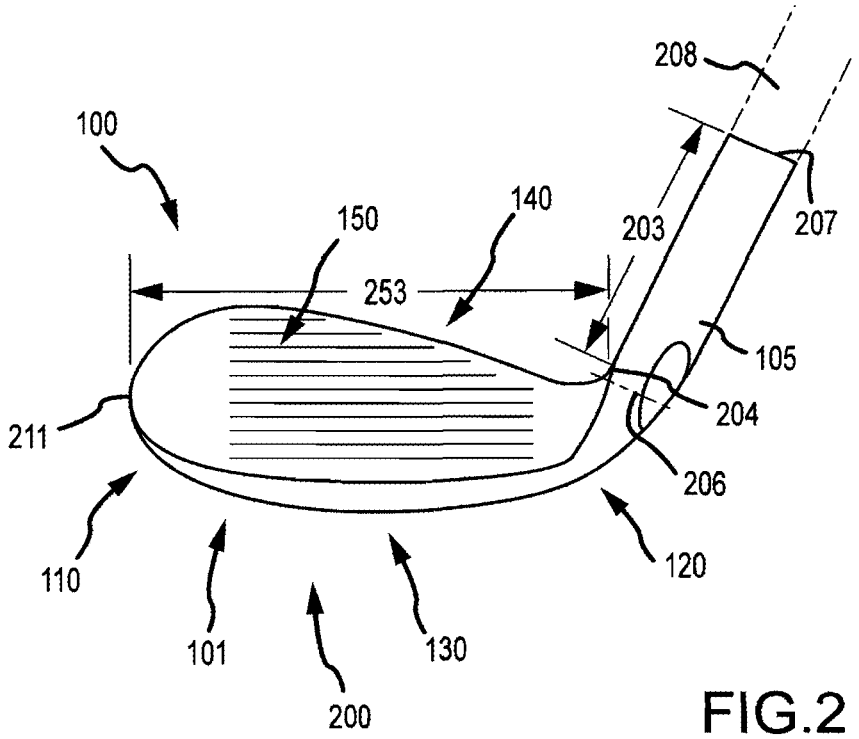
FIG. 2 illustrates a front view of the exemplary golf club head of FIG. 1.

Turning now to the figures, FIG. 1 illustrates a rear, exploded perspective view of an exemplary golf club head 100 according to an embodiment of golf clubs and methods of manufacture, and FIG. 2 illustrates a front view of the golf club head 100. In one embodiment of the golf clubs and methods of manufacture described herein, the golf club head 100 comprises a body 101 having a toe region 110, a heel region 120 opposite the toe region 110, a hosel 105 at the heel region 120, a sole region 130, and a top region 140 opposite the sole region 130. The sole region 130 may extend from the heel region 120 to the toe region 110, and the sole region 130 may extend from a front face 250 (FIG. 2) to a back sole edge 165. In a different embodiment, the golf club head 100 may have a bore (not shown), instead of the hosel 105, at the heel region 120.

Figure 5:
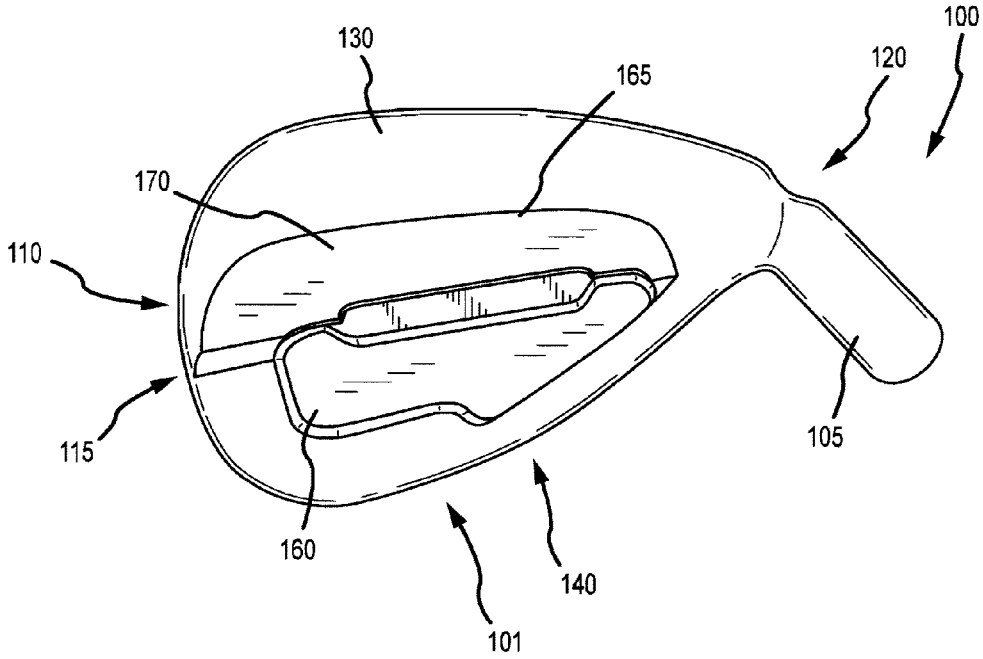
FIG. 5 illustrates a perspective view of the exemplary golf club head of FIG. 1.

The golf club head 100 further comprises a first back 160 (FIG. 1) opposite the front face 250 (FIG. 2), a second back 170 (FIG. 1) opposite the front face 250 (FIG. 2) and extending farther from the front face 250 (FIG. 2) than the first back 160 (FIG. 1), as explained in more detail hereinafter. The first back 160 may be substantially parallel to the front face 250 (FIG. 2) and the first back 160 may extend from the heel region 120 to the toe region 110. The first back 160 may also extend from the sole 130 to a midpoint 115 (FIG. 1) between the sole region 130 and the top region 140, and may further extend from the midpoint 115 to the top region 140. The second back 170 (FIG. 1) may extend from the heel region 120 to the toe region 110, and may extend from the sole region 130 to about the midpoint 115 (FIG. 1) between the sole region 130 and the top region 140, as can be seen in FIGS. 1 and 5. In a different embodiment, back face 170 (FIG. 1) may extend from the sole region 130 beyond the midpoint 115, or the back face 170 may extend from the sole region 130 below the midpoint 115.

Figure 3:
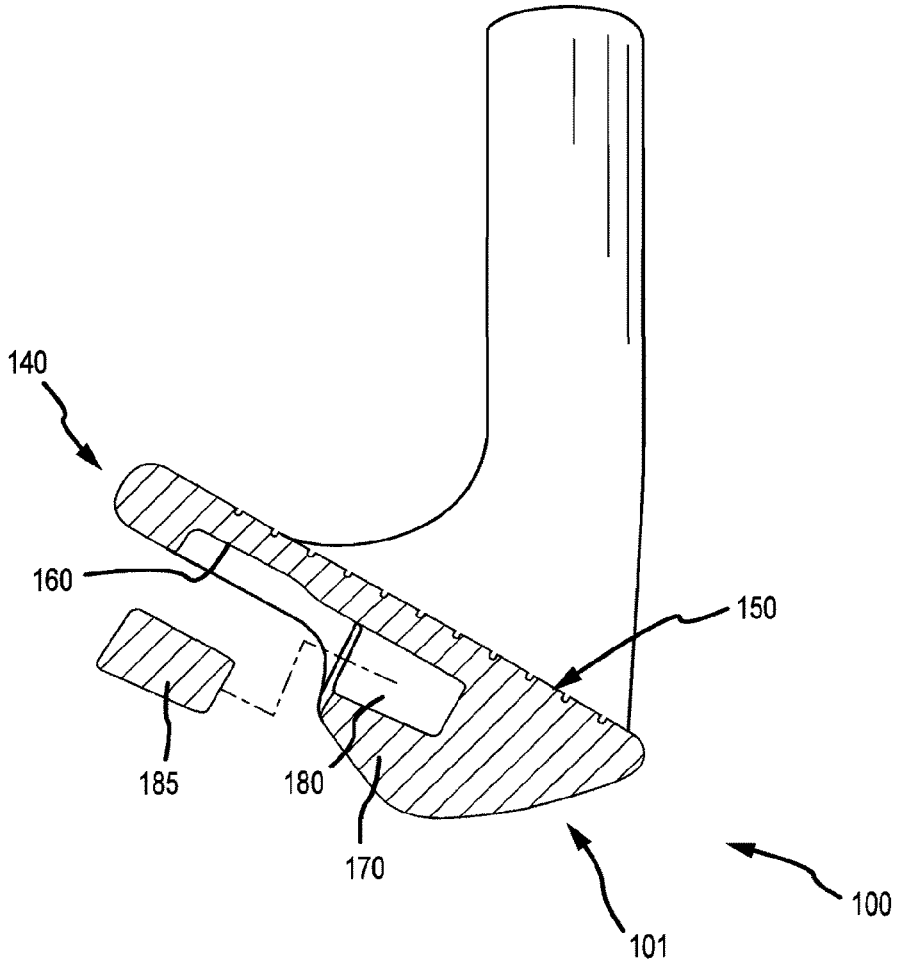
FIG. 3 illustrates an exploded, cross-sectional view of the exemplary golf club head, taken from a section line 3-3 in FIG. 1.

As illustrated in FIGS. 1 and 3, the golf club head 100 further comprises a first cavity 180 between the first back 160 and the second back 170. As illustrated in FIG. 3, the first cavity 180 separates the first back 160 from the second back 170, and vice versa. According to the various embodiments described herein, the golf clubs and methods of manufacture comprise the first cavity 180 to have a rectangular shape, but other configurations are contemplated. For example, the first cavity 180 may comprise an irregular shape, or a different regular shape, for example, triangular, circular, octagonal, hexagonal, and the like. In another example, the first cavity 180 may comprise a symmetrical shape or an asymmetrical shape. Moreover, the first cavity 180 may comprise various dimensions.

Figure 4:
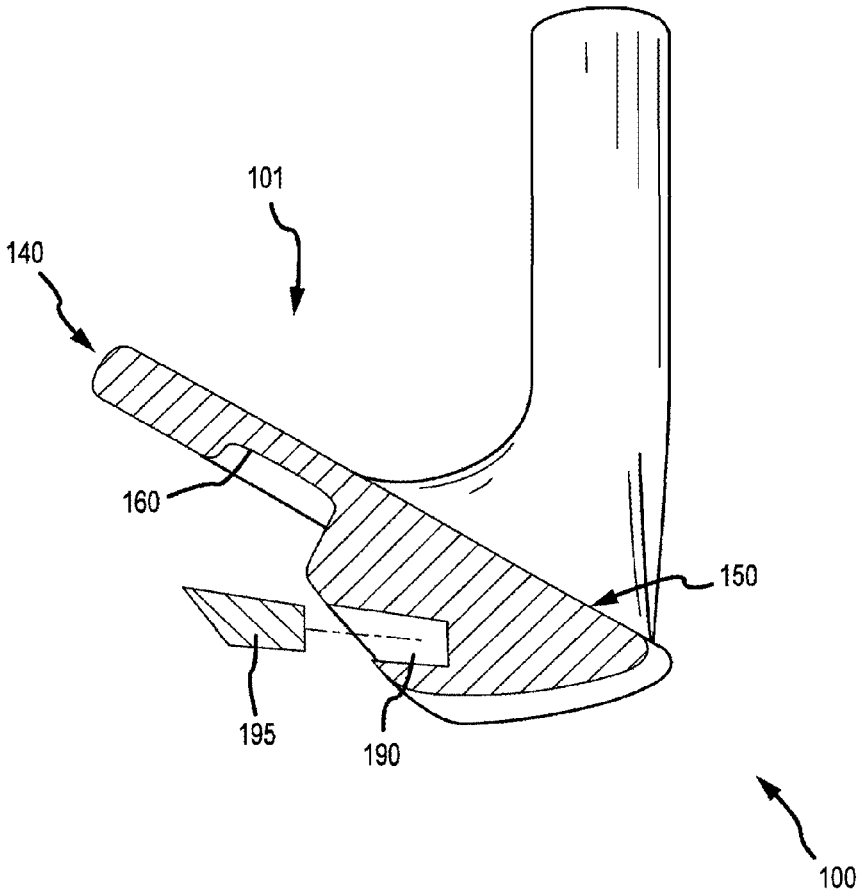
FIG. 4 illustrates an exploded, cross-sectional view of the exemplary golf club head, taken from a section line 4-4 in FIG. 1.

As illustrated in FIGS. 1 and 4, the golf club head 100 also comprises a second cavity 190 integral with the second back 170 at the lower toe region 110. Similar to the first cavity 180, the second cavity 190 may also comprise various shape and dimensional configurations. The shape and dimensional of the first cavity 180 and the second cavity 190 may be determined by the variables that optimize the utility of the golf club head 100, and to adjust the moments of inertia, the center of gravity, and the like. Also, the golf clubs and methods of manufacture described herein, may further comprise cavities that vary in volume, and the volume may depend upon the desired design of the golf club head. Although the above examples may describe two cavities (e.g., the first and second cavities 180 and 190), the golf clubs and methods of manufacture described herein may include additional cavities.

This embodiment of golf club head 100 may further comprises a first weight 185 that is inserted in the first cavity 180 and a second weight 195 that is inserted in the second cavity 190. According to the various embodiments described herein, first weight 185 and second weight 195 may comprise various shapes and dimensional configurations. For example, the first weight 185 and the second weight 195 may comprise shapes and dimensions that are complimentary to the respective cavities into which they are inserted (e.g., the first and second cavities 180 and 190, respectively). In another example, the first weight 185 and the second weight 195 may comprise shapes that only partially occupy the cavities into which they are inserted, or the first weight 185 and the second weight 195 may comprise shapes that overfill the first and second cavities 180 and 190, respectively. The first weight 185 and the second weight 195 can comprise various materials. In one embodiment, the first weight 185 comprises a metal matrix material. In another embodiment, the first weight 185 comprises a polymer, and may be either a thermoset or thermoplastic polymer. First weight 185 may comprise a specific gravity of approximately 1 g/cm$^3$ (grams per cubed centimeter) to approximately 9 g/cm$^3$ in some examples. The second weight 195 may comprise a metal, and may be either a single elemental metal such as iron, or a metal alloy, such as tungsten or titanium alloy. In this embodiment, the first weight 185 comprises a metal matrix material because it generally provides the ability to adjust the back weighting more so than the lightest, or least dense metal or metal alloy, and the second weight 195 comprises a metal because an outer toe weight may be beneficial to induce a golfer to swing "downwardly" and "outwardly." In another embodiment, the first weight 185 and the second weight 195 may comprise of the same material, such as a polymer, a composite, a metal, or a metal alloy. The body 101 can comprise standard golf club head materials such as iron, iron alloys, titanium alloys, and the like, and the first weight 185 and the second weight 195 can comprise the same or different materials as the body 101. As with the shape determination for the first and second cavities, the material determination may be similarly dependant upon the variables that maximize the utility of the golf club head, and other material configurations other than those specifically described are contemplated.

In another embodiment of golf clubs and methods of manufacture, and with reference to FIG. 2 a golf club 200 comprises the golf club head 100 coupled to a shaft 208. In this embodiment, the golf club 200 may further comprise a hosel ratio of 0.75. The hosel ratio comprises a hosel distance 203 to a front face distance 253. The hosel distance 203 measures from a first end 206 at about the heel region 120 to a second end 207 opposite the first end 206. The first end 206 is located at a point 204 where a linear portion of the hosel 105 begins to curve into the front face 250. The front face distance 253 comprises the distance measured along the front face 250 from the point 204 to a toe edge 211 and substantially parallel to the sole 130. The golf club 200 may further comprise, for example as shown in FIG. 1, the first weight 185 to occupy the first cavity 180 and the second weight 195 to occupy the second cavity 190.

The golf club 200, as described herein with the cavities and inserted weights of the golf club head 100, provides for an exemplary golf club that assists a golfer to improve his or her golf swing by allowing for customization of the back weight and toe weight in the club head 100. Furthermore, among the various embodiments described herein, the golf clubs and their methods of manufacture may be for irons, drivers, fairway woods, hybrids, putter, and or other suitable types of clubs.

In an embodiment of golf clubs and methods of manufacture, a method 600 for manufacturing a golf club head comprises providing a golf club head (a block 610). The golf club head of the block 610 may be similar to the golf club head 100 shown in FIGS. 1-5. Method 600 further comprises determining a first weight (a block 620), securing the first weight in a first cavity (a block 630), determining a second weight (a block 640), and securing the second weight in a second cavity (a block 650). As an example, the first weight of the block 620 may be similar to the first weight 185 of FIG. 1, and the second weight of the block 640 may be similar to the second weight 195 of FIG. 1.

Furthermore, the determining step in the block 620 may include having a professional golf technician analyze a golfer's swing. Depending on the swing analyzed by the professional golf technician, a lighter or heavier weight may be determined. Similarly, the determining step in the block 640 may likewise include determining whether to use a lighter or heavier weight based upon analysis of a golfers swing by a professional golf technician. In addition or alternatively, software, firmware, and/or hardware may be used to determine the first weight (e.g., monitor, measure, and/or analyze various parameters associated with an individual's golf swing).

In an embodiment of golf clubs and methods of manufacture, a method 700 for manufacturing a golf club, comprises providing a golf club head (the block 610), determining a first weight (the block 620), securing the first weight in a first cavity (the block 630), determining a second weight (the block 640), securing the second weight in a second cavity (the block 650), and coupling the body to a golf club shaft (a block 760). As an example, the shaft of the block 760 may be similar to the shaft 208 of FIG. 2. Also, the coupling step of the block 760 can include taping, adhering, welding, swaging, or other suitable techniques.

According to the method embodiments described herein, the method for securing the first and/or second weight(s) comprises any process to secure the weights in their respective cavities. For example, if either of the weights comprises a polymer material, then the weights may be glued and/or secured by an adhesive. If, for example, either of the weights is made of metal, then the weights may be similarly glued or secured by an adhesive, and additionally may be secured by any other known method for securing a metal within a cavity, such as welding, swaging, and the like.

Figure 6:
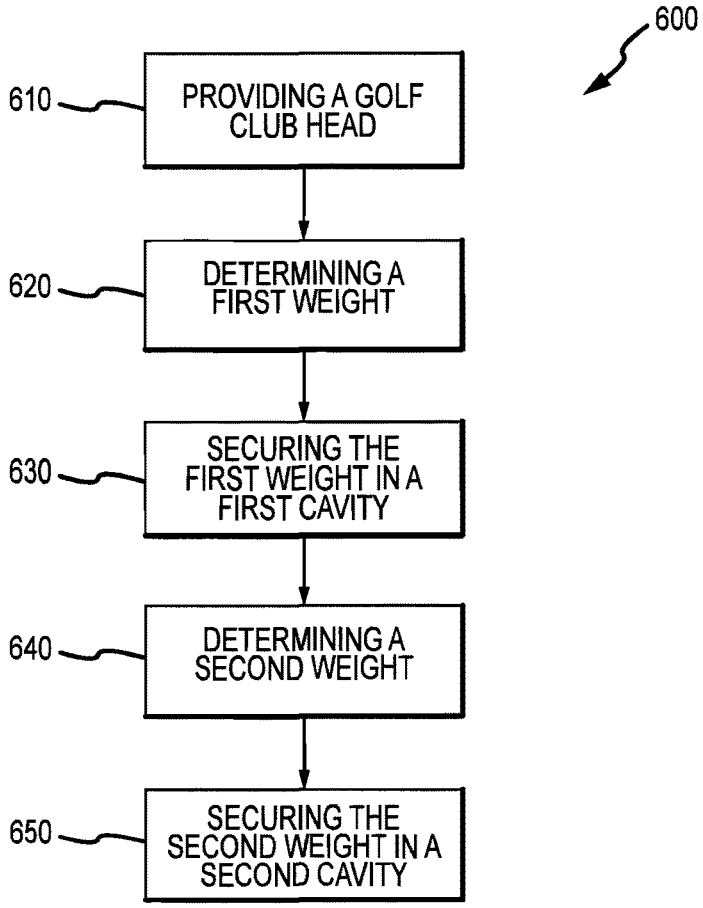
FIG. 6 depicts a flow diagram representation of one manner in which a golf club head may be manufactured.
Figure 7:
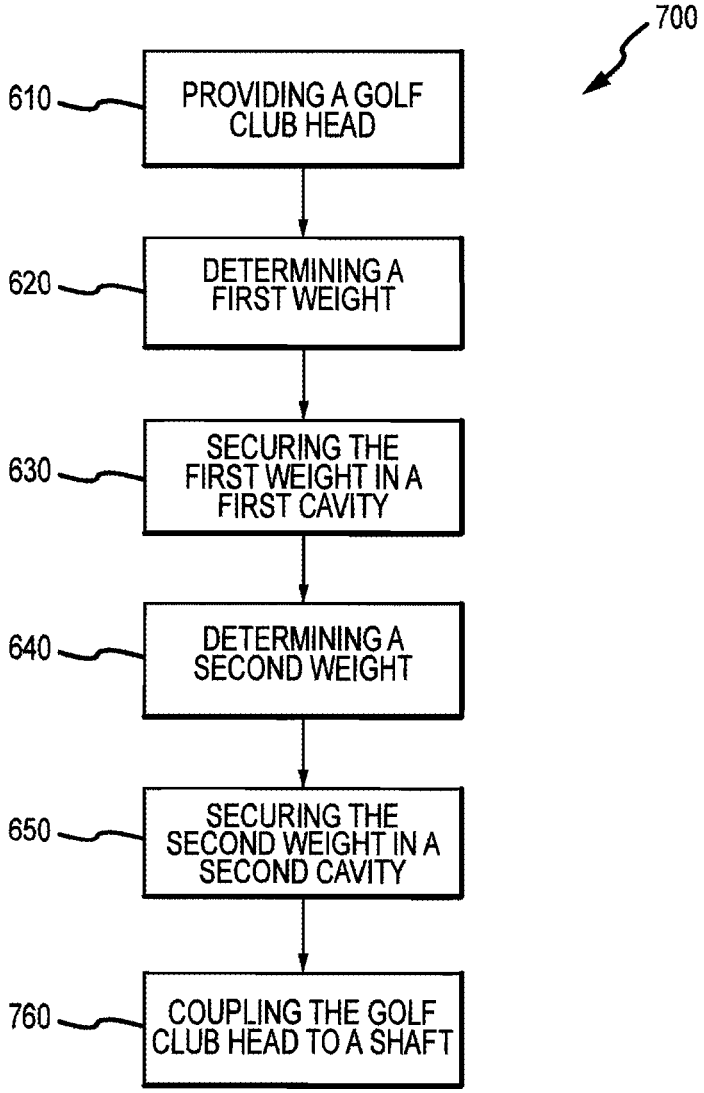
FIG. 7 depicts a flow diagram representation of one manner in which a golf club may be manufactured.

Although a particular order of actions is illustrated in FIGS. 6 and 7, these actions may be performed in other temporal sequences. For example, the actions depicted in FIGS. 6 and 7 may be performed sequentially, concurrently, or simultaneously. Also, the blocks 640 and 650 can be performed before the blocks 620 and 630, and the blocks 620 and 640 may be performed before the blocks 630 and 650.

The providing steps in the described methods of FIGS. 6 and 7 may include designing and/or manufacturing a golf club head. As an example, body 100 in FIG. 5 may be manufactured using a metal casting process. Furthermore, the described methods may be used to manufacture the other aspects of body 100 described with reference to FIGS. 1-5.

Figure 8:
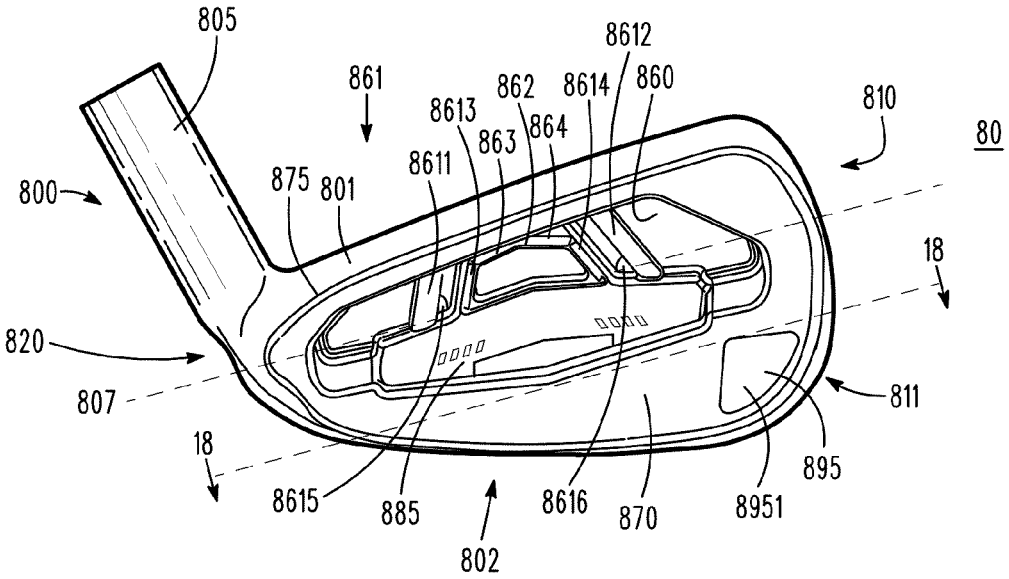
FIG. 8 presents a rear view of a club head of a club head set with varying characteristics according to an embodiment of the golf clubs and methods of manufacture described herein.
Figure 9:
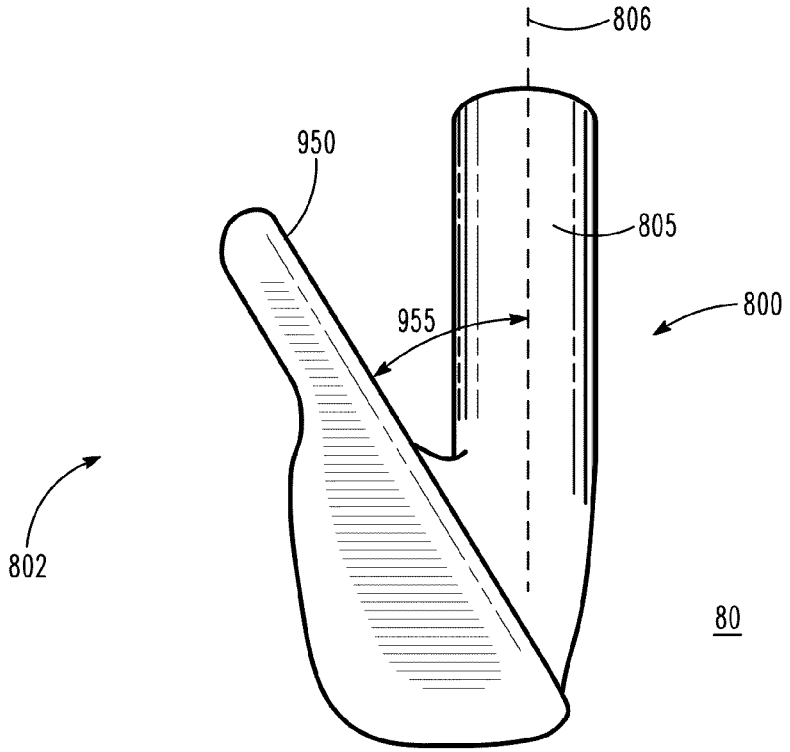
FIG. 9 presents a toe side view of the club head of FIG. 8.
Figure 10:
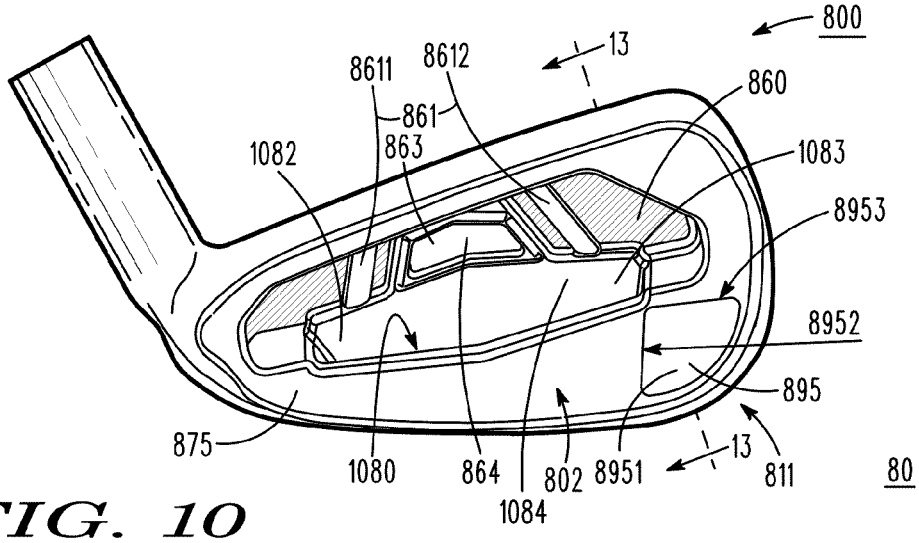
FIG. 10 illustrates a rear view of a body of the club head of FIG. 8, where the club head is in a disassembled state.

Continuing with the figures, FIG. 8 presents a rear view of club head 800 of club head set 80 according to an embodiment of the golf clubs and methods of manufacture described herein. FIG. 9 presents a toe side view of club head 800. FIG. 10 illustrates a rear view of body 801 of club head 800, where club head 800 is in a disassembled state. Club head 800 is similar to club head 100 (FIGS. 1-5), and comprises loft angle 955 (FIG. 9) between front face 950 (FIG. 9) and shaft bore axis 806. In the present example of FIG. 9, shaft bore axis 806 is defined by a bore of hosel 805, but there can be other hosel-less examples where shaft bore axis 806 could be defined by a shaft bore at a heel of a club head body. In the present example of FIG. 8, club head 800 also comprises back portion 802 comprising back face 860 opposite front face 950 (FIG. 9) and extended between toe region 810 and heel region 820 of back portion 802. In some embodiments, back portion 802 can also be referred to as a back side of club head 800. Club head 800 also comprises inserts 885 and 895 in the present embodiment. Insert 885 can be similar to weight 185 (FIGS. 1, 3), and can be inserted at back portion 802 into a cavity 1080 (FIG. 10) similar to cavity 180 of club head 100 (FIGS. 1, 3, 5). Lower toe insert 895 can be similar to weight 195 of club head 100 (FIGS. 1, 4). Club head 800 comprises part of club head set 80 of two or more golf clubs, as will be further discussed below.

Club head 800 also comprises insert 862 located at insert base 863 at a center of back face 860 in the present embodiment. As shown in FIG. 8, insert 862 comprises a logo or other identifying characteristic related to club head 800. There can be embodiments where insert 862 can comprise materials such as those described for weight 185 and/or weight 195 in FIGS. 1, 3, and 4, such as to have an effect on sound, vibration, frequency, and/or mass distribution of club head 800.

Club head 800 differs from club head 100 (FIGS. 1-5) by comprising support bars 861 coupled to back face 860 astride of, and equidistant from, center region 864. Support bars 861 comprise support bars 8611 at heel region 820, and support bar 8612 at toe region 810, both protruding from back face 860. There can be other examples, however, with a different number and/or different arrangement of support bars. For example, additional support bars may be positioned between support bar 8611 and the heel end of heel region 820. Similarly, additional support bars may be positioned between support bar 8612 and the toe end of toe region 810. In some examples, insert base 863 may be considered as also comprising one or more support bars. For example, base ends 8613 and 8614 of insert base 863 can also be considered in some examples as support bars protruding from back face 860. In addition, there can be examples where insert base 863 is protruding from back face 860, such that insert base 863 may itself be considered a support bar.

In the present embodiment, support bars 8611 and 8612 comprise substantially the same support bar width. In the same or other embodiments, the support bar width can be of approximately 0.03 inches (0.75 millimeters) to approximately 0.5 inches (12.7) millimeters). Although the support bar width is constant for both support bars 8611 and 8612 in the example of FIG. 8, there can be other examples where the support bar width tapers or otherwise varies along a length of a support bar similar to support bar 8611 and/or 8612. In addition, although the support bar thickness also is constant for support bars 861 in the present example, there also can be examples where the support bar thickness can taper or otherwise vary, as measured from back face 860, along a length of a support bar similar to support bar 8611 and/or 8612.

Support bars 861 are integral with back face 860 in the present embodiment by comprising part of the same piece of material. For example, support bars 861 can be cast, forged, or machined along with back face 860. There can be other embodiments where support bars may not be integral with their respective back faces, but are securely attached thereto. In such examples, the support bars can be welded, brazed, epoxied, or otherwise adhered to the back faces.

In the present embodiment, support bar 8611 comprises angle 8615 facing center region 864 and measured from horizontal axis 807. Similarly, support bar 8612 also comprises angle 8616 facing center region 864 and measured from horizontal axis 807. Horizontal axis 807 is an axis bisecting club 800 into an upper half and a lower half. There can be embodiments where angles 8615 and/or 8616 comprise acute angles of approximately 30 degrees to approximately 90 degrees from horizontal axis 807. In the same or other embodiments, support bars 8611 and 8612 are angled for convergence towards center region 864. There can also be embodiments where angles 8615 and/or 8616 can be obtuse and/or of approximately 90 degrees to approximately 150 degrees from horizontal axis 807. Angles 8615 and 8616 both comprise approximately 68 degrees in the example of FIG. 8, but there can be other embodiments where angles 8615 and 8616 are not equal to each other, and/or where at least one of angles 8615 and/or 8616 are not acute relative to center region 864. Angles 8615 and/or 8616 may remain constant across the different club heads of club head set 80, or they may vary within the same club head set from club head to club head.

Figure 18:
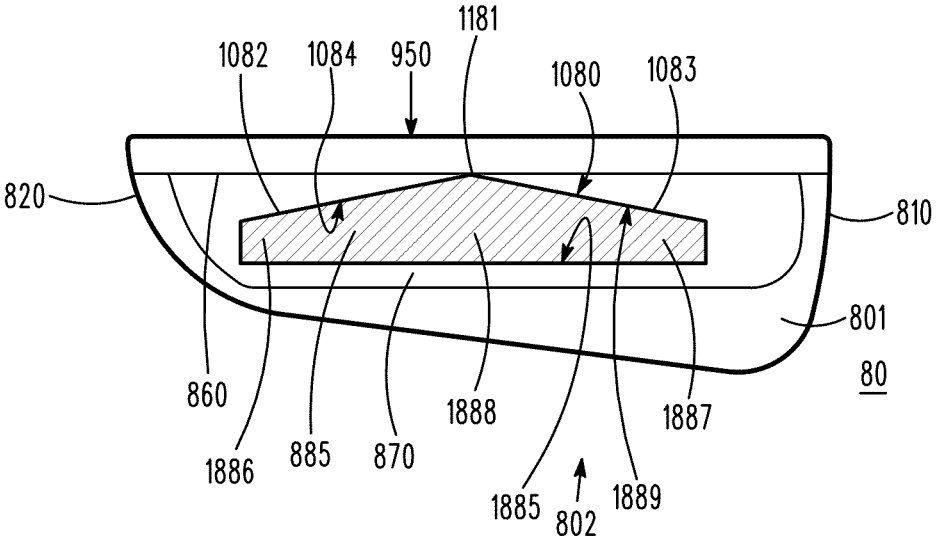
FIG. 18 illustrates a cross-sectional view of the club head of FIG. 8 along line 18-18 from FIG. 8.

FIG. 10 illustrates a rear view of body 801 of club head 800 in a disassembled state. Skipping ahead in the figures, FIG. 18 illustrates a cross-sectional view of club head 800 along line 18-18 from FIG. 8. Note that, for simplicity, details about lower toe insert 895 have been left out of FIG. 18, but insert 885 is shown as inserted into cavity 1080. As seen in FIGS. 8, 10, and 18, back portion 802 of club head 800 comprises back end 870 extended between heel region 820 and toe region 810, where back end 870 can be similar to second back 170 of club head 100 (FIGS. 1, 3-5). In some examples, back end 870 can be referred to as a back wall. Cavity 1080 is also located at back portion 802, between back face 860 and back end 870, and comprises cavity heel zone 1082, cavity toe zone 1083, cavity center zone 1181, cavity inner section 1084 located towards front face 950, and cavity outer section 1885 located towards back end 870. In the present example, cavity inner section 1084 is located opposite back face 860, and cavity outer section 1885 is located opposite back end 870. In the present embodiment, as seen in FIG. 18, cavity 1080 is wider at cavity center zone 1181 than at either of cavity heel zone 1082 or cavity toe zone 1083. For example, cavity inner section 1084 is thinner, relative to front face 950, at cavity center zone 1181 than at either of cavity heel zone 1082 or cavity toe zone 1083. In some examples, cavity inner section 1084 can be referred to as a cavity inner wall, and/or cavity outer section 1885 can be referred to as a cavity outer wall.

In the present example, a distance between front face 950 and an exposed surface of cavity inner section 1084 is greater at cavity heel zone 1082 and at cavity toe zone 1083 than at cavity center zone 1181. There can also be embodiments where a distance between back end 870 and an exposed surface of cavity outer section 1885 can be greater at cavity heel zone 1082 and at cavity toe zone 1083 than at cavity center zone 1181.

Insert 885 comprises insert heel zone 1886, insert toe zone 1887, and insert center zone 1888 in the present embodiment, and is shaped complementarily to cavity 1080 such that insert center zone 1888 is thicker than either of insert heel zone 1886 or insert toe zone 1887. In the example of FIG. 18, insert heel and toe zones 1886 and 1887 are obtusely angled relative to each other along insert inner wall 1889 and about insert center zone 1888. Similarly, cavity inner section 1084 is obtusely angled complementarily to insert inner wall 1889. In the present example, cavity 1080 is configured such that insert 885 is insertable in a top-to-sole direction with respect to club head 800. There can also be examples where insert 885 can be interchangeable with other inserts of similar shape.

In some examples, a material of body 801 of club head 800 can comprise a specific gravity of at least approximately 5.0 g/cm$^3$, and/or a material of insert 885 can comprise a specific gravity of at least approximately 1.2 g/cm$^3$. In the same or other examples, a mass of insert 885 can be of approximately 10 grams.

The dimension relationships described above for and between cavity 1080 and insert 885 can be beneficial, for example, to permit adjustments in the distribution of mass for club head 800. In the present embodiment, where a material of insert 885 is less dense than a material of body 801 of club head 800, the greater thickness of cavity inner section 1084 at cavity heel zone 1082 and at cavity toe zone 1083, relative to cavity center zone 1181, and the greater thickness of insert center zone 1888 relative to insert heel zone 1886 and insert toe zone 1887, can permit a redistribution of mass away from a center of club head 800 and towards heel and toe regions 820 and 810. As an example, a distribution of mass of cavity inner section 1084 is shifted towards heel region 820 and towards toe region 810 and away from cavity center zone 1181. Also, a distribution of mass of insert 885 is concentrated at insert center zone 1888 and diminishes towards insert heel zone 1886 and towards insert toe zone 1887.

Such distributions of mass can augment the moment of inertia about a center region of club head 800, and improve gameplay by reducing club head twisting during off-center impacts. For example, due to the shapes and configurations described above, a portion of the moment of inertia contributed by cavity inner section 1084 at cavity heel zone 1082 and at cavity toe zone 1083 is greater than a portion of the moment of inertia contributed by insert 885 at insert heel zone 1886 and at insert toe zone 1887. Other shape and/or density relationships between insert 885 and cavity 1080 may be used to achieve different desired distributions of mass or moments of inertia in other embodiments.

As shown in FIGS. 8 and 18, insert 885 is partially housed in cavity 1080, such that a grip portion of insert 885 protrudes outside cavity 1080 to allow or facilitate, for example, insertion or removal of insert 885 to or from cavity 1080. In other embodiments, however, insert 885 need not protrude from cavity 1080. Support bars 861 also extend from back face 860 to cavity inner section 1084 in the present embodiment, and cavity inner section 1084 is at least as thick as support bars 861, relative to back face 860, so as to prevent support bars 861 from interfering with the insertion or removal of insert 885 into or out of cavity 1080.

Figure 11:
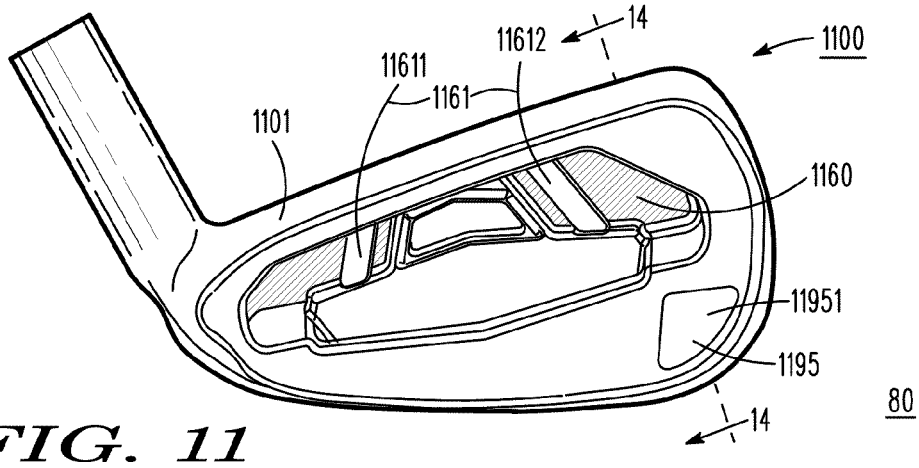
FIG. 11 illustrates a rear view of a body of another club head of the club head set of the club head of FIG. 8, where the club head is in a disassembled state.
Figure 12:
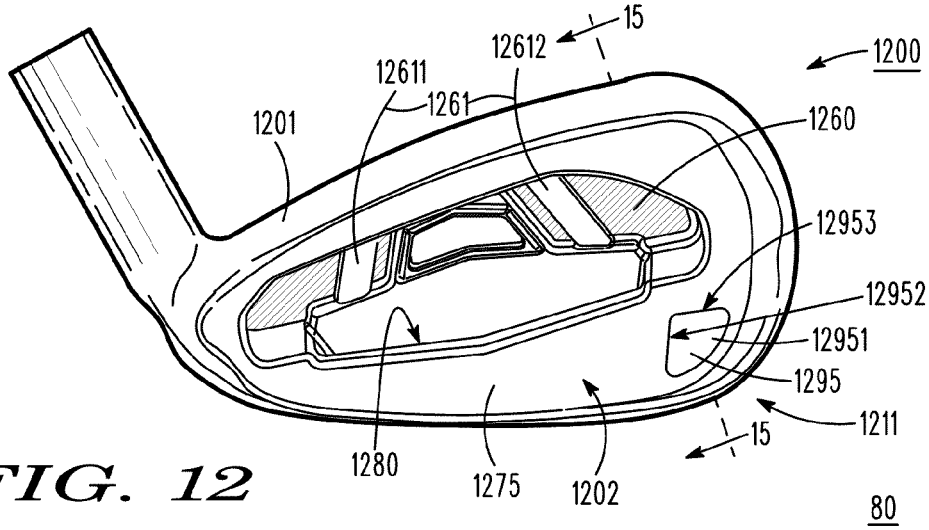
FIG. 12 illustrates a rear view of a body of yet another club head of the club head set of the club head of FIG. 8, where the club head is in a disassembled state.
Figure 15:
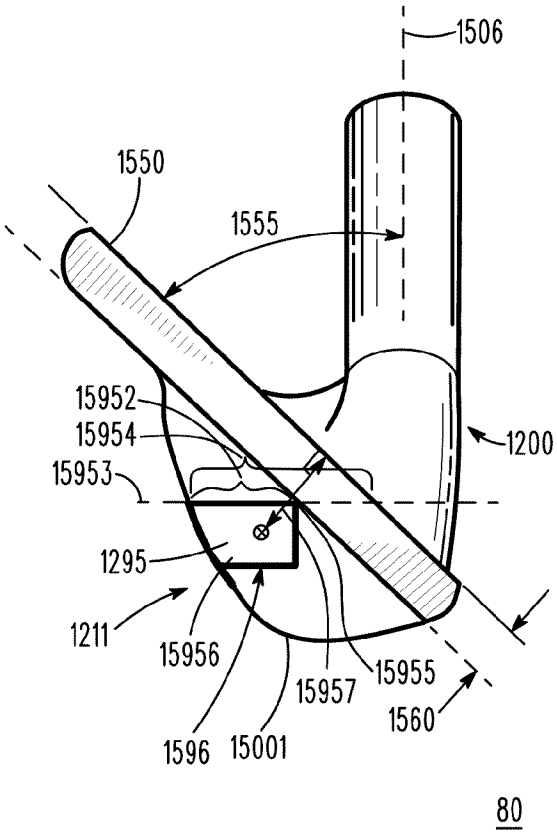
FIG. 15 illustrates a cross-sectional view of the club head of FIG. 12 along a line 15-15 of FIG. 12.
Figure 14:
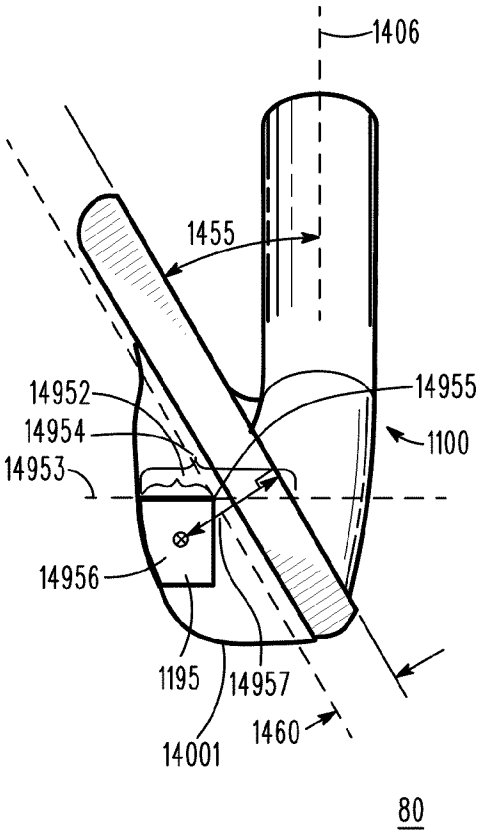
FIG. 14 illustrates a cross-sectional view of the club head of FIG. 11 along a line 14-14 of FIG. 11.
Figure 13:
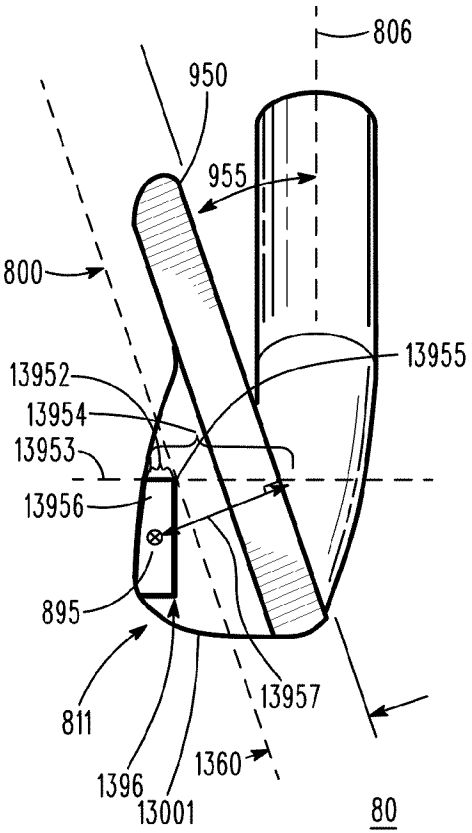
FIG. 13 illustrates a cross-sectional view of the club head of FIGS. 8 and 10 along a line 13-13 of FIG. 10.

Backtracking through the figures, FIGS. 10-15 illustrate several views of exemplary club heads of club head set 80. FIG. 10 illustrates a rear view of body 801 of club head 800, where club head 800 is in a disassembled state. FIG. 11 illustrates a rear view of body 1101 of club head 1100 of club head set 80, where club head 1100 is in a disassembled state. FIG. 12 illustrates a rear view of body 1201 of club head 1200 of club head set 80, where club head 1200 is in a disassembled state. FIG. 13 illustrates a cross-sectional view of club head 800 along a line 13-13 of FIG. 10. FIG. 14 illustrates a cross-sectional view of club head 1100 along a line 14-14 of FIG. 11. FIG. 15 illustrates a cross-sectional view of club head 1200 along a line 15-15 of FIG. 12. Club heads 800, 1100, and 1200 can be similar to each other, as detailed below.

In the present example, club heads 800, 1100, and 1200 form part of club head set 80 of related golf clubs, where club head set 80 can comprise two or more club heads. Only club heads 800, 1100, and 1200 of club head set 80 are shown in FIGS. 10-12 for simplicity, but club head set 80 can comprise more than three club heads. There also can be other embodiments where club head set 80 can comprise only two club heads. Each club head of club head set 80 comprises one or more support bars protruded from their respective back faces. For example, as seen in FIGS. 8 and 10, club head 800 comprises support bars 861, including support bars 8611 and 8612 protruded from back face 860, as detailed above. As seen in FIG. 11, club head 1100 comprises support bars 1161, namely, support bars 11611 and 11612, protruded from back face 1160. In addition, as seen in FIG. 12, club head 1200 comprises support bars 1261, namely, support bars 12611 and 12612, protruded from back face 1260.

In the present example, the loft angles of the club heads of club head set 80 are incrementally varied across the two or more club heads. For instance, in the present example of club head set 80, club head 800 comprises a 2-iron club head with loft angle 955 (FIG. 9) of approximately 18.5 degrees between front face 950 and shaft bore axis 806, (FIG. 13); club head 1100 comprises a 6-iron club head with loft angle 1455 of approximately 30.5 degrees between front face 1450 and shaft bore axis 1406 (FIG. 14); and club head 1200 comprises a wedge-iron club head with loft angle 1555 of approximately 47 degrees between front face 1550 and shaft bore axis 1506 (FIG. 15). As a result, the loft angle 1555 of club head 1200 is greater than loft angle 1455 of club head 1100, which, in turn, is greater than loft angle 955 of club head 800.

Also in the present example, a characteristic of the one or more support bars is incrementally varied across the two or more club heads according to the loft angle. For instance, loft angle 1555 is greater than loft angle 1455 as discussed above, and accordingly, an attribute of support bars 1261 of golf club 1200 (FIG. 12) is greater than an attribute of support bars 1161 of golf club 1100 (FIG. 11). In the present example, the attribute of the support bars that undergoes variation is the support bar width, such that support bars 1261 (FIG. 12) are wider than support bars 1161 (FIG. 11), and support bars 1161 (FIG. 11) are wider than support bars 861 (FIG. 10).

Figure 16:
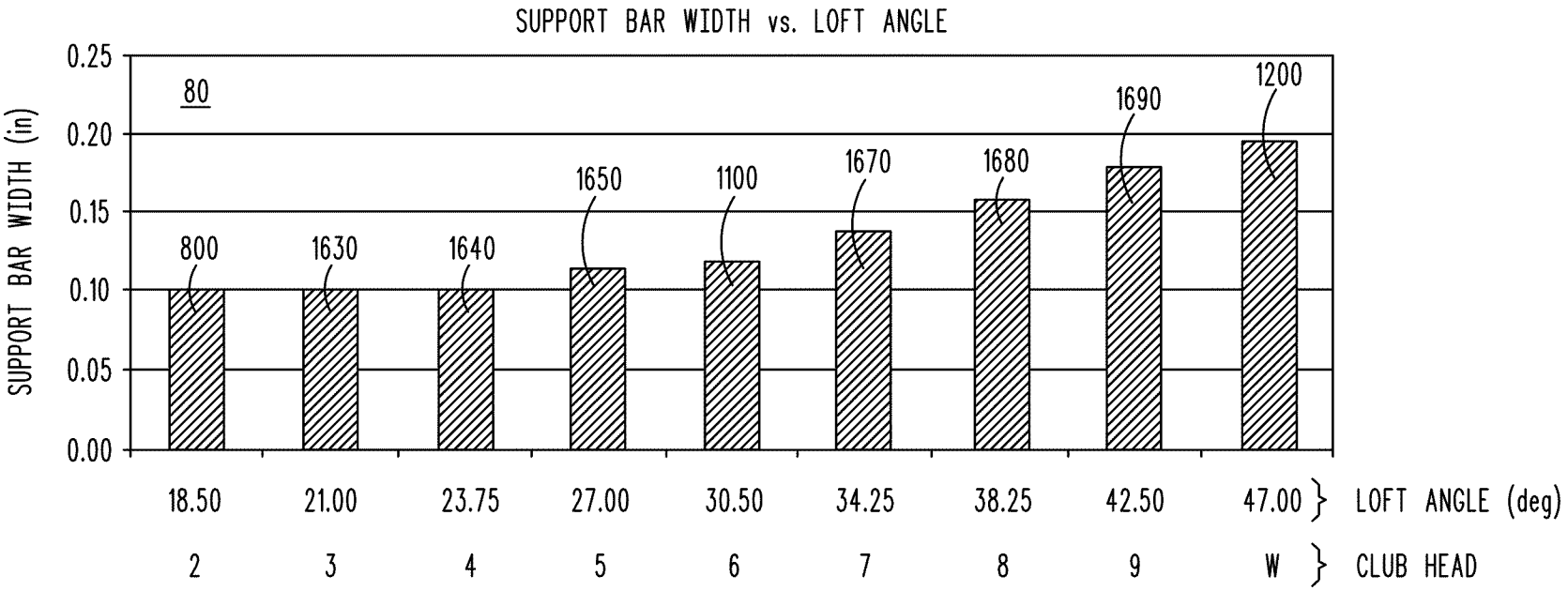
FIG. 16 illustrates a chart of an exemplary relationship between support bar width relative to loft angle for the exemplary club head set of FIGS. 8-15.

The variation of support bar width relative to loft angle is summarized in FIG. 16 for the exemplary club head set 80. In the present example, club head set 80 comprises club head 800 as a 2-iron head, club head 1630 as a 3-iron head, club head 1640 as a 4-iron head, club head 1650 as a 5-iron head, club head 1100 as a 6-iron head, club head 1670 as a 7-iron head, club head 1680 as an 8-iron head, club head 1690 as a 9-iron head, and club head 1200 as a wedge-iron head. As can be appreciated from FIG. 16, the support bar width attribute is varied incrementally as the loft angle increases from one club head to the next in club head set 80. As a result, the support bar width for a club with a higher loft angle is greater than or equal to the support bar width for a club with a lower loft angle. There can be examples, however, where the characteristic and/or attribute of the one or more support bars can be incrementally varied for each increment in loft angle, such that the support bar width for a club with higher loft angle is greater than the support bar width for any club with a lower loft angle.

Figure 22:
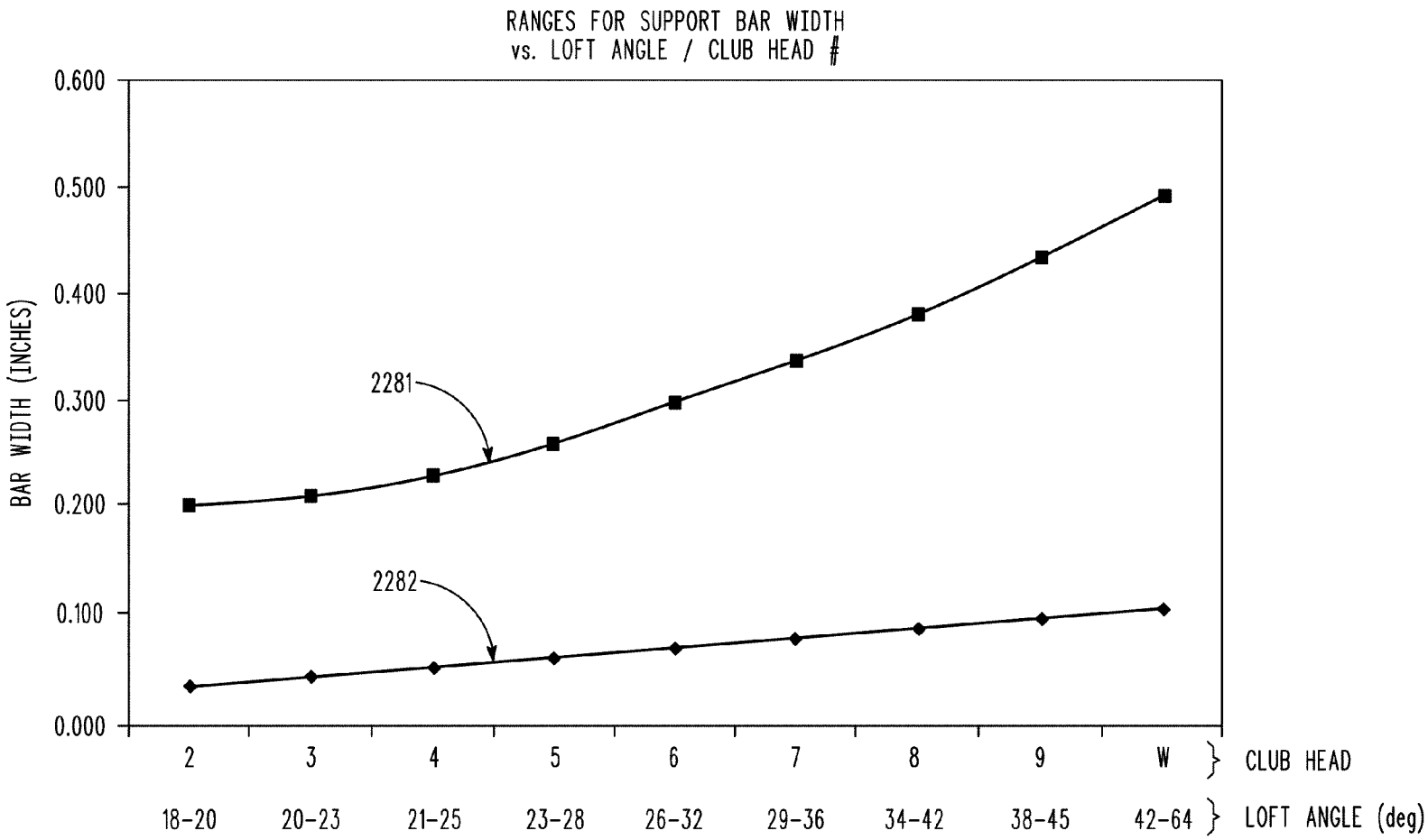
FIG. 22 illustrates a chart with sample ranges for relationships between the support bar widths and the loft angles/club head numbers.

Skipping ahead in the figures, as seen in FIG. 22, relationships between support bar width and loft angle/club head number may lie within one or more ranges. For example, club head set 2281 comprises club heads with thicker support bar widths that vary from club head to club head as indicated in FIG. 22. Similarly, in another example, club head set 2282 comprises club heads with thinner support bar widths that vary from club head to club head as also indicated in FIG. 22. Other examples or rates of variation are also possible for other club head sets.

In the same or other examples, support bar widths may vary within certain ranges, depending on the loft angle and/or the club head number, for club heads of one or more club head sets. For instance:

For a 2-iron head, the loft angle can comprise approximately 18 degrees to approximately 20 degrees, and the support bar width can comprise approximately 0.03 inches (0.75 millimeters) to approximately 0.2 inches (5.1 millimeters);

For a 3-iron head, the loft angle can comprise approximately 20 degrees to approximately 23 degrees, and the support bar width can comprise approximately 0.04 inches (1.0 millimeters) to approximately 0.21 inches (5.3 millimeters);

For a 4-iron head, the loft angle can comprise approximately 21 degrees to approximately 25 degrees, and the support bar width can comprise approximately 0.05 inches (1.3 millimeters) to approximately 0.23 inches (5.8 millimeters);

For a 5-iron head, the loft angle can comprise approximately 23 degrees to approximately 28 degrees, and the support bar width can comprise approximately 0.06 inches (1.5 millimeters) to approximately 0.26 inches (6.6 millimeters);

For a 6-iron head, the loft angle can comprise approximately 26 degrees to approximately 32 degrees, and the support bar width can comprise approximately 0.07 inches (1.8 millimeters) to approximately 0.30 inches (7.6 millimeters);

For a 7-iron head, the loft angle can comprise approximately 29 degrees to approximately 36 degrees, and the support bar width can comprise approximately 0.08 inches (2.0 millimeters) to approximately 0.34 inches (8.7 millimeters);

For a 8-iron head, the loft angle can comprise approximately 34 degrees to approximately 42 degrees, and the support bar width can comprise approximately 0.09 inches (2.3 millimeters) to approximately 0.39 inches (9.8 millimeters);

For a 9-iron head, the loft angle can comprise approximately 38 degrees to approximately 45 degrees, and the support bar width can comprise approximately 0.10 inches (2.5 millimeters) to approximately 0.44 inches (11.2 millimeters); and/or For a wedge-iron head, the loft angle can comprise approximately 42 degrees to approximately 64 degrees, and the support bar width can comprise approximately 0.11 inches (2.8 millimeters) to approximately 0.50 inches (12.7 millimeters).

In the same or other embodiments, one or more other characteristics or attributes of the support bars can vary, besides, instead of, or in addition to the support bar width, in a fashion similar to that described above for the support bar width. For example, in one embodiment, the other characteristic or attribute can comprise a support bar thickness, measured from the back face, that may be incrementally varied according to the loft angle. In such an example, a thickness of support bars 1261 of club head 1200 in FIG. 12 could be thicker than a thickness of support bars 1161 of club head 1100 in FIG. 11, and/or a thickness of support bars 1161 of club head 1100 in FIG. 11 could be thicker than a thickness of support bars 861 of club head 800 in FIG. 10.

Figure 17:
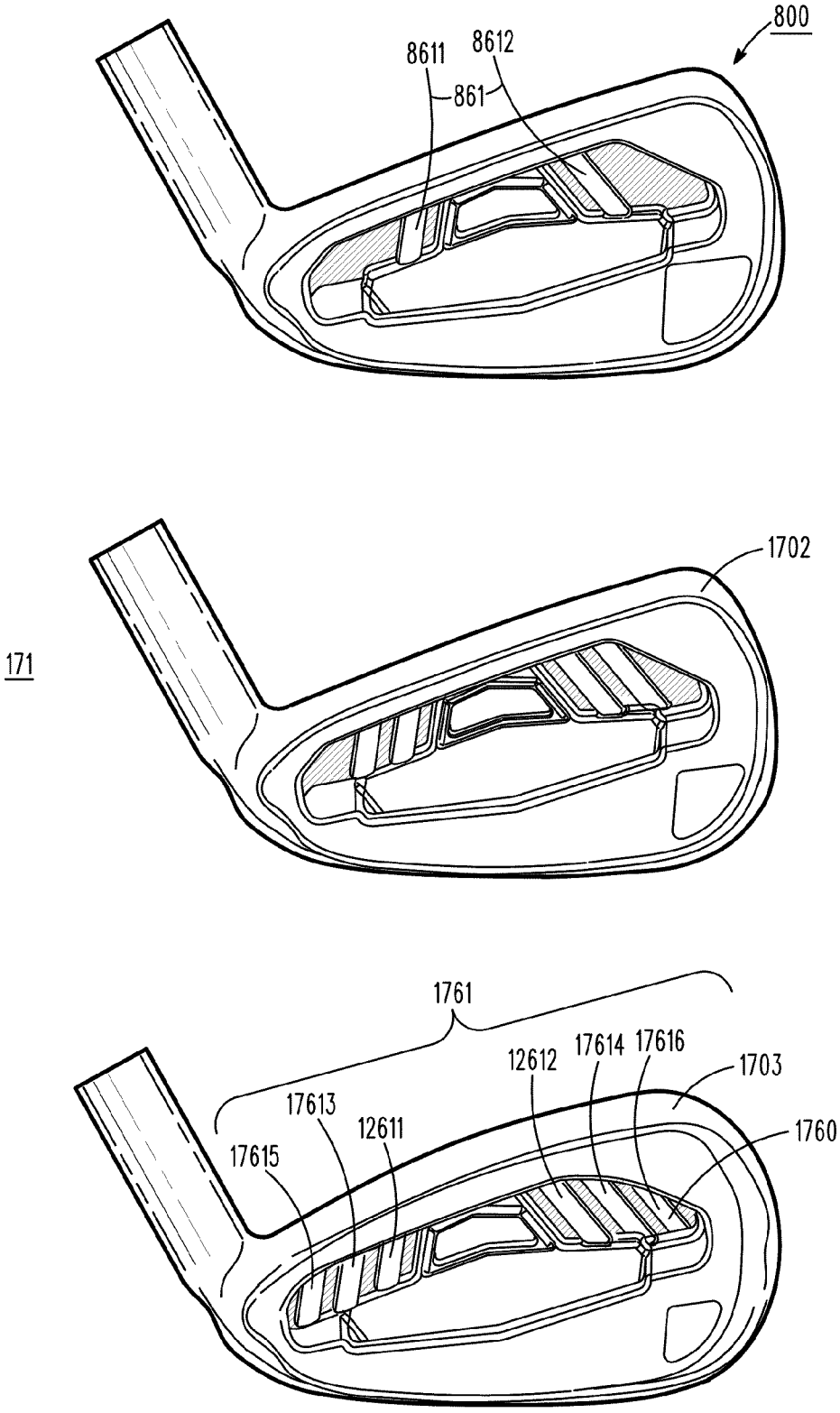
FIG. 17 illustrates several club heads of a club head set with varying characteristics according to an embodiment of the golf clubs and methods of manufacture described herein.

In the same or another embodiment, the other characteristic or attribute can comprise a total number of support bars that may be incrementally varied according to the loft angle. Such an embodiment is illustrated in FIG. 17 for club head set 171, comprising club head 800, club head 1702 similar to club head 1100, and club head 1703 similar to club head 1200. In the example of FIG. 17, the loft angle for club head 1703 is greater than the loft angle for club head 1702, and the loft angle for club head 1702 is greater than the loft angle for club head 1701, such that the total number of support bars for club head 1703 is greater than the total number of support bars for club head 1702, and the total number of support bars for club head 1702 is greater than the total number of support bars for club head 1701. In one example, the support bar width, thickness, and angle remains the same for each of the support bars in a single club head. In other examples, more than one characteristic or attribute is varied per club head, and/or support bars within a single club head can have different widths, thicknesses, and/or angles.

The incorporation of support bars at the back faces of the club heads of club head sets as described above can be beneficial for several reasons. For example, the placement of support bars proximate to a center region at back face of a club head can increase support for the front face and/or face plate to better withstand stresses associated with impacts to golf balls. Such additional support can be useful in situations where the face plate thickness has been minimized for weight savings and/or weight redistribution considerations.

In the case of short irons, such as wedge heads like club head 1200 in FIGS. 12 and 15, the placement of wider and/or thicker support bars such as support bars 1261 at back face 1260 just opposite to front face 1550 can have the effect of shifting the center of gravity of club head 1200 towards the front thereof. This shift can reduce a gear effect between front face 1550 and a golf ball, thereby limiting spin imparted onto the golf ball upon impact with front face 1550 for better trajectory control. In addition, better distance control and repeatability may be gained as a result of added face stability and reduced face deflection during impact due to the wider and/or thicker support bars. In some examples, similar results can also be achieved by having an increased number of support bars, such as in the case of support bars 1761 of club head 1703 in FIG. 17.

In the case of long irons, such as 2-irons like club head 800 in FIGS. 8, 10, and 13, the moment of inertia of the club head can be increased for better control by decreasing the relevant characteristic or attribute of the support bars, whether it be support bar width, support bar thickness, and/or total number of support bars, such that more of the mass of club head 800 can be distributed towards the edges of front face 950 of club head 800 for increased moment of inertia. In addition, longer and/or more penetrating flight paths may be achieved due to the decreased relevant support bar characteristic by permitting greater flexure of the front face and/or face plate of the club head.

Furthermore, in cases such as depicted for club head set 80, because the support bars are visible at the back face of the club heads, an increase in user confidence may be achieved for users that can appreciate the enhanced support, strength, and control features that the arrangement of support bars provides.

Backtracking to FIG. 8, club head 800 also is shown as comprising lower toe insert 895 in addition to insert 885 and related cavity 1080 (FIG. 10). There can be, however, other embodiments comprising insert 885 and cavity 1080 without lower toe insert 895, and/or other embodiments comprising lower toe insert 895 without insert 885 and cavity 1080. Similar variations in features can be extended for other clubs of respective club head sets. For example, all or part of the club heads of club head set 80 may comprise lower toe inserts similar to lower toe insert 895, in addition to inserts and related cavities similar to insert 885 and related cavity 1080. There can also be embodiments where all or a portion of the club heads of a club head set may comprise inserts and related cavities similar to insert 885 and related cavity 1080, but may lack lower to inserts similar to lower toe insert 895. There can also be embodiments where all or a portion of the club heads of a club head set may comprise lower toe inserts similar to lower toe insert 895, but may lack inserts and related cavities similar to insert 885 and related cavity 1080.

Continuing with FIG. 8, lower toe insert 895 can be similar to weight 195 of club head 100 (FIGS. 1, 4) and, in the present example, also comprises a weight. Lower toe insert 895 is located at lower toe section 811 of back portion 802, and although club head 800 comprises perimeter weight 875, lower toe insert 895 is located only at lower toe section 811. In the present example, lower toe insert 895 comprises a tungsten material and a specific gravity of approximately 10 g/cm$^3$ In the present example, the other club heads of club head set 80 also comprise corresponding lower toe inserts similar to lower toe insert 895.

In some examples, lower toe insert 895 and/or other similar inserts can be located at lower toe portion 811 to effect a redistribution of mass of club head 800. For example, lower toe insert 895 can be configured to shift the mass distribution of club head 800 away from center region 861 and towards toe region 810 and/or lower toe section 811 to thereby increase the moment of inertia of club head 800. In the same or other examples, lower toe insert 895 can be configured to counterbalance the mass of hosel 805 at the heel or upper heel portion of club head 800. By having hosel 805 and lower toe insert 895 substantially opposite each other, the distribution of mass of club head 800 can be shifted towards the ends of club head 800 to thereby increase its moment of inertia and forgiveness factor. In the same or other examples, the dimensions, location, and/or mass of lower toe insert 895 can be configured such as to adjust or align the center of gravity of club head 800 at a desired location relative to heel region 820 and/or toe region 810.

As previously described, the loft angles of the club heads of club head set 80 are incrementally varied across the two or more club heads in the present example. In addition, characteristics or dimensions of the corresponding lower toe inserts are also varied across the two or more club heads of club head set 80 in relation with the variation in loft angle. For instance, where each lower toe insert comprises two characteristics, the two characteristics can be inversely varied relative to each other for each lower toe insert across the club heads of club head set 80 as the loft angle is varied. As an example, a varied characteristic of the lower toe inserts may be incrementally varied, while an inverse characteristic of the lower toe inserts is decrementally varied as the loft angle changes.

The variation in characteristics relative to loft angle can be further appreciated as presented in FIGS. 10-15, for the example of club head set 80, via club heads 800, 1100, and 1200. As seen in FIGS. 13-15, loft angle 1555 of club head 1200 is greater than loft angle 1455 of club head 1100, which in turn is greater than loft angle 955 of club head 800. Furthermore, for the present embodiment, as loft angles increase from club head to club head, lower toe thicknesses, as measured along respective depth axes of the club heads, tend to increase from club head to club head. In the same and other embodiments, the lower toe thickness of a club head can be related and/or defined by a sole of the club head. As an example, lower toe thickness 15954 (FIG. 15) of club head 1200 is greater than lower toe thickness 14954 (FIG. 14) of club head 1100, which in turn is greater than lower toe thickness 13954 (FIG. 13) of club head 800. Similarly, lower toe thickness 13954 of club head 800 is defined by, and comprises a portion of, a thickness of sole 13001 (FIG. 13), while lower toe thickness 15954 of club head 1200 is defined by, and comprises a portion of, a thickness of sole 15001 (FIG. 15), such that the thickness of sole 15001 is greater than the thickness of sole 13001.

In the embodiment of club head set 80, the varied characteristic can be a depth of the lower toe insert, while the inverse characteristic can be an area of the lower toe insert. As an example, for club head 800, insert depth 13952 (FIG. 13) of lower toe insert 895 is measured along depth axis 13953, where depth axis 13953 traverses minimum distance point 13955 between lower toe insert 865 and front face 950, where insert area 8951 (FIGS. 8, 10) represents a cross-sectional area of lower toe insert 895 substantially perpendicular to depth axis 13953 and/or where depth axis 13953 is substantially parallel to sole 13001 (FIG. 13) and/or is substantially perpendicular to shaft bore axis 806. Similarly, for club head 1100, insert depth 14952 (FIG. 14) is measured along depth axis 14953, where depth axis 14953 traverses minimum distance point 14955 between lower toe insert 1195 and front face 1450, where insert area 11951 (FIG. 11) represents a cross-sectional area of lower toe insert 1195 substantially perpendicular to depth axis 14953, and/or where depth axis 14953 is substantially parallel to sole 14001 (FIG. 14) and/or is substantially perpendicular to shaft bore axis 1406. As another example, for club head 1200, insert depth 15952 (FIG. 15) is measured along depth axis 15953, where depth axis 15953 traverses minimum distance point 15955 between lower toe insert 1295 and front face 1550, and where insert area 12951 (FIG. 12) represents a cross-sectional area of lower toe insert 1295 substantially perpendicular to depth axis 15953, and/or where depth axis 15953 is substantially parallel to sole 15001 (FIG. 15) and/or is substantially perpendicular to shaft bore axis 1506. In such examples, where the varied characteristic of lower toe insert depth (13952, 14952, 15952) increases from club head 800 to club head 1200, the inverse characteristic of lower toe area (8991, 11951, 12951) decreases from club head 800 to club head 1200. In a different embodiment, the lower toe insert depth (13952, 14952, 15952) increases as the loft angle (955, 1455, 1555) increases.

In the same or other embodiments, one of the characteristics or dimensions that vary can be a distance between a center of gravity of the lower toe insert and the front face of respective club head. For instance, a distance between the center of gravity of a lower toe insert and the front face of a corresponding lower-lofted club head can be greater than a distance between the center of gravity of a lower toe insert and the front face of a corresponding higher-lofted club head. As an example, distance 13957 between center of gravity 13956 of lower toe insert 895 and front face 950 of club head 800 (FIG. 13) is greater than distance 14957 between center of gravity 14956 of lower toe insert 1195 and front face 1450 of club head 1100 (FIG. 14), which in turn is greater than distance 15957 between center of gravity 15956 of lower toe insert 1295 and front face 1550 of club head 1200 (FIG. 15). In such examples, where the varied characteristic of lower toe insert depth (13952, 14952, 15952) increases from club head 800 to club head 1200, the inverse characteristic of center of gravity distance (13957, 14957, 15957) decreases from club head 800 to club head 1200. In a different embodiment, the center of gravity distance (13957, 14957, 15957) decreases as the loft angle (955, 1455, 1555) increases.

The club head variations described above based on loft angle can permit the insert depths of the lower toe inserts to vary. For example, insert depth 15952 (FIG. 15) of insert 1295 is greater than insert depth 14952 (FIG. 14) of insert 1195, which in turn is greater than insert depth 13952 (FIG. 13) of lower toe insert 895. Furthermore, distances between the lower toe inserts and the respective club head front faces can vary accordingly. In the present example of club head 80, insert-to-face distance 1360 (FIG. 13) of club head 800 is of approximately 0.281 inches (7.14 millimeters), which is greater than insert-to-face distance 1460 (FIG. 14) of club head 1100 at approximately 0.233 inches (5.92 millimeters), which, in turn, is greater than insert-to-face distance 1560 (FIG. 15) of club head 1200 at approximately 0.195 inches (4.95 millimeters).

Such variation in the insert depths of the lower toe inserts, in the distances between the lower toe inserts and their respective club head front faces, and/or in the distances between the center of gravity of the lower toe inserts and their respective club head front faces, can vary mass distribution for the club heads, thereby permitting the adjustment of certain qualities of the club heads.

For example, by having shallower insert depths and/or larger insert-to-face distances for lower-lofted club heads, the center of gravity of such club heads can be moved away from the respective club head front faces, thereby increasing club head dynamic loft and imparted spin such as to allow higher launch angles and/or flight trajectories for impacted balls. Conversely, by having deeper insert depths and/or shallower insert-to-face distances for higher-lofted club heads, the center of gravity of such club heads can be moved closer to the respective club head front faces, thereby allowing for more penetrating flight paths for impacted balls.

The variation in insert depth described above could lead to a variation in mass of the different lower toe inserts of the club heads. To counteract such mass variation, and the effects it could have on other qualities of the club heads, like the counterbalancing of respective hosels with respective lower toe inserts, other characteristics or dimensions of the lower toe inserts can be varied inversely with respect to the variation in insert depth. For example, as the insert depths of the lower toe inserts increase, an area of the lower toe inserts can be decreased, such that all lower toe inserts comprise substantially similar masses. In some embodiments, a mass of each of the lower toe inserts of club head set 80 comprises approximately 10.25 grams. In the same or other examples, such mass may be of approximately 5 grams to approximately 50 grams. In the example of club head set 80, as insert depths vary by increasing from insert depth 13952 (FIG. 13) to insert depth 14952 (FIG. 14), and from insert depth 14952 to insert depth 15952 (FIG. 15), corresponding areas for the inserts inversely vary by decreasing from insert area 8951 (FIG. 10) to insert area 11951 (FIG. 11), and from insert area 11951 (FIG. 11) to insert area 12951 (FIG. 12).

Figure 19:
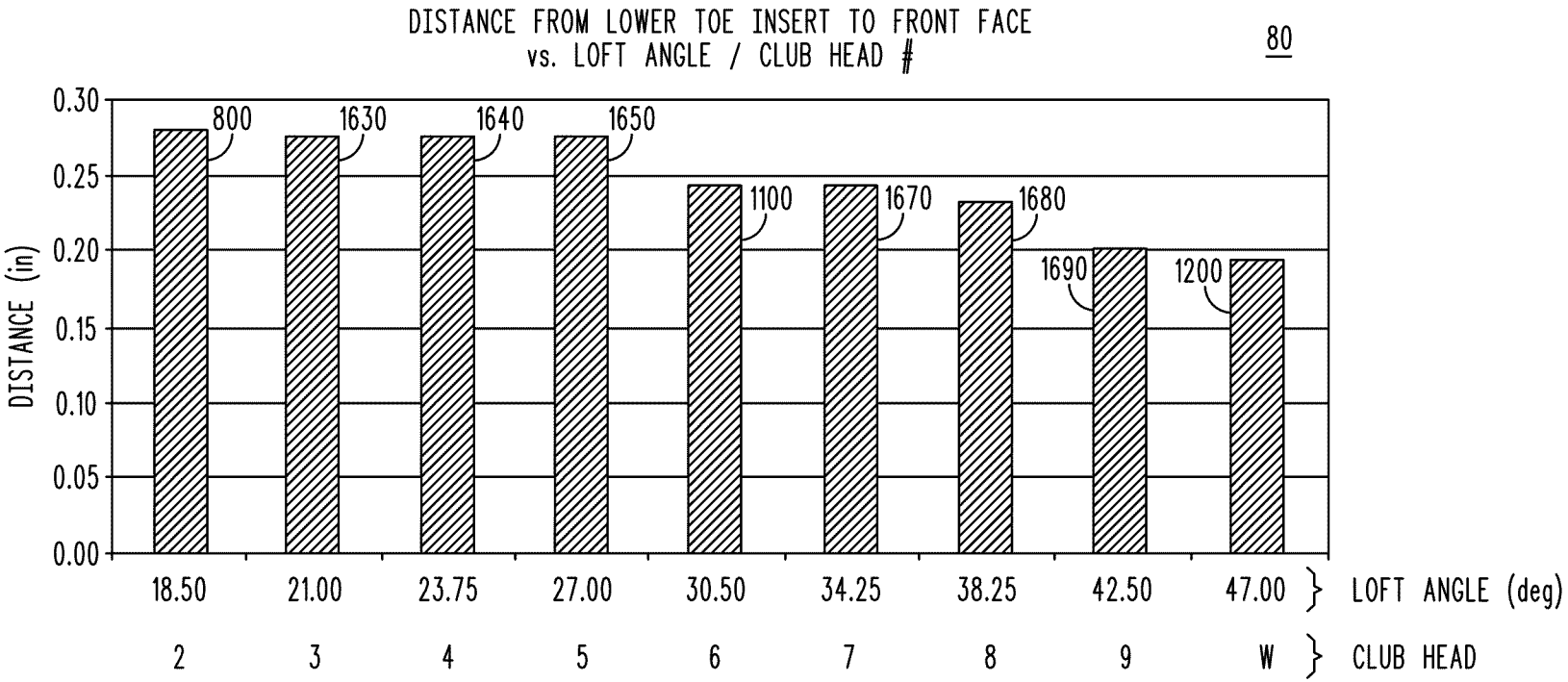
FIG. 19 illustrates a chart of exemplary relationship between loft angle and distances between lower toe inserts to front faces for the exemplary club heads of FIGS. 8-18 according to an embodiment of the golf clubs and methods of manufacture described herein.
Figure 23:
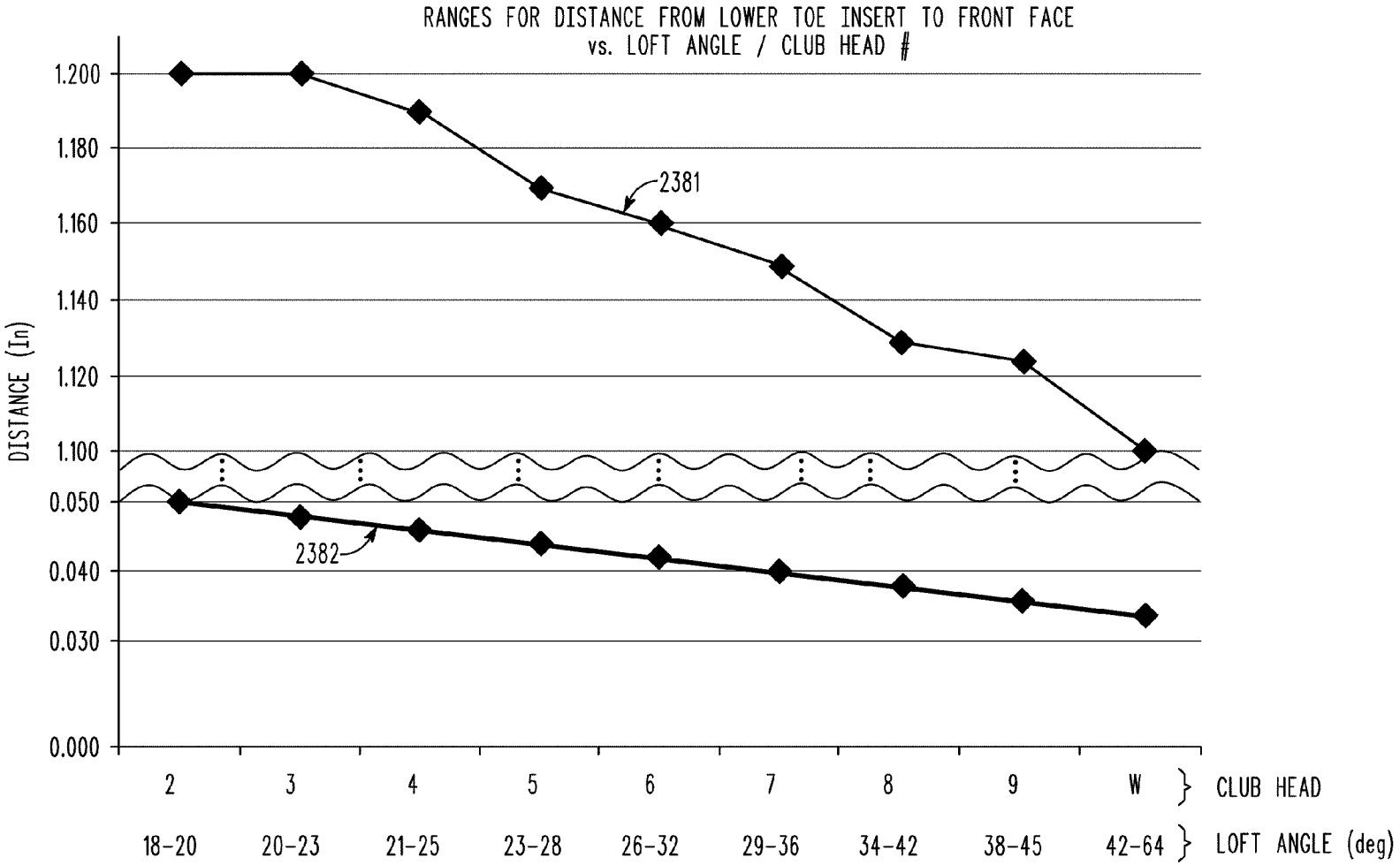
FIG. 23 illustrates a chart with sample ranges for relationships between the distances from the lower toe inserts to the club head front faces and the loft angles/club head numbers.

FIG. 19 illustrates an exemplary relationship between loft angle and the distances between lower toe inserts to front faces for the embodiment of club head set 80. Skipping ahead in the figures, as seen in FIG. 23, relationships between front-face-to-lower-toe-weight distances and loft angle/club head number may lie within one or more ranges. For example, club head set 2381 comprises club heads with longer front-face-to-lower-toe-weight distances that vary from club head to club head as indicated in FIG. 23. Similarly, in another example, club head set 2382 comprises club heads with shorter front-face-to-lower-toe-weight distances that vary from club head to club head as also indicated in FIG. 23. The club heads of club head set 2381 can have soles that are generally wider, from front to back of the club head, than the soles of the club heads of club head set 2382. Other examples or rates of variation are also possible for other club head sets.

In the same or other examples, front-face-to-lower-toe-weight distances may vary within certain ranges, depending on the loft angle and/or the club head number, for club heads of one or more club head sets. For instance:

- A 2-iron front-face-to-lower-toe-weight distance can comprise approximately 0.050 inches (1.27 millimeters) to approximately 1.2 inches (28.08 millimeters);
- A 3-iron front-face-to-lower-toe-weight distance can comprise approximately 0.048 inches (1.22 millimeters) to approximately 1.2 inches (28.08 millimeters);
- A 4-iron front-face-to-lower-toe-weight distance can comprise approximately 0.046 inches (1.17 millimeters) to approximately 1.19 inches (27.85 millimeters);
- A 5-iron front-face-to-lower-toe-weight distance can comprise approximately 0.044 inches (1.12 millimeters) to approximately 1.17 inches (27.38 millimeters);
- A 6-iron front-face-to-lower-toe-weight distance can comprise approximately 0.042 inches (1.07 millimeters) to approximately 1.16 inches (27.14 millimeters);
- A 7-iron front-face-to-lower-toe-weight distance can comprise approximately 0.040 inches (1.02 millimeters) to approximately 1.15 inches (26.91 millimeters);
- A 8-iron front-face-to-lower-toe-weight distance can comprise approximately 0.038 inches (0.97 millimeters) to approximately 1.13 inches (26.44 millimeters);
- A 9-iron front-face-to-lower-toe-weight distance can comprise approximately 0.036 inches (0.91 millimeters) to approximately 1.125 inches (26.33 millimeters); and/or
- A wedge-iron front-face-to-lower-toe-weight distance can comprise approximately 0.034 inches (0.86 millimeters) to approximately 1.10 inches (25.74 millimeters).

Backtracking to FIGS. 13-15, to simplify matters, relationships between higher-lofted club heads and lower-lofted club heads, with respect to their lower-toe inserts, will be described below by referencing club heads 800 and 1200 of club head set 80. Relationships between other club heads may be extrapolated or interpolated based on the description below of club heads 800 and 1200.

In the present example of club head set 80, lower toe insert 895 of club head 800, and lower toe insert 1295 of club head 1200, comprise weights with substantially similar masses. In addition, dimensions of lower toe inserts 895 and 1295 correspond to each other, such that insert depth 13952 (FIG. 13) of lower toe insert 895 corresponds to insert depth 15952 (FIG. 15) of lower toe insert 1295, and insert area 8951 (FIG. 10) of lower toe insert 895 corresponds to insert area 12951 (FIG. 12) of lower toe insert 1295. Insert areas 8951 and 12951 can represent cross-sectional areas and/or back-end areas of their respective lower toe inserts in the present or other embodiments. In the present example, because insert depth 15952 of lower toe insert 1295 is greater than insert depth 13952 of lower toe insert 895, insert area 8951 of lower toe insert 895 is greater than insert area 12951 of lower toe insert 1295. As a result, the insert area and insert depth dimensions are inversely varied relative to each other.

Furthermore, as seen in FIGS. 13 and 15, insert-to-face distance 1560 between lower toe insert 1595 and front face 1550 is greater than insert-to-face distance 1360 between lower toe insert 895 and front face 950. In the present example, insert-to-face distance 1560 comprises a shortest distance between front face 1550 and lower toe insert 1295, while insert-to-face distance 1360 comprises a shortest distance between front face 950 and lower toe insert 895. Such relationships described above between lower toe inserts (895, 1295) and front faces (950, 1550) of respective club heads 800 and 1200 define respective distributions of mass such that a center of gravity of club head 1200 can be closer to front face 1550 than a center of gravity of club head 800 is to front face 950.

In the present examples, both lower toe inserts 895 and 1295 are visible at their respective lower toe sections of club heads 800 and 1200. In some examples, such visibility of the lower toe inserts may inspire user confidence for users that can appreciate the enhanced performance and control features that the arrangement of the respective lower toe inserts provides. There can be other embodiments, however, where lower toe inserts may not be visible. For example, the interface between the lower toe insert 895 and lower toe section 811 may blend or otherwise become indiscernible after machining or polishing steps.

In the example of club head set 80, club head 800 comprises perimeter weight 875 at a periphery of back portion 802, and club head 1200 comprises perimeter weight 1275 at a periphery of pack portion 1202. Perimeter weight 875 comprises a cavity at lower toe section 811, where lower toe insert 895 is located. Similarly, perimeter weight 1275 comprises a cavity at lower toe section 1211, where lower toe insert 1295 is located. As a result, the lower toe inserts can be integrated with their respective perimeter weights while still being located only at their respective lower toe sections. In addition, in the present example, lower toe insert 1295 is incompatible with the cavity of lower toe section 811 in club head 800, while lower toe insert 895 is incompatible with the cavity of lower toe section 1211 in club head 1200.

Figure 20:
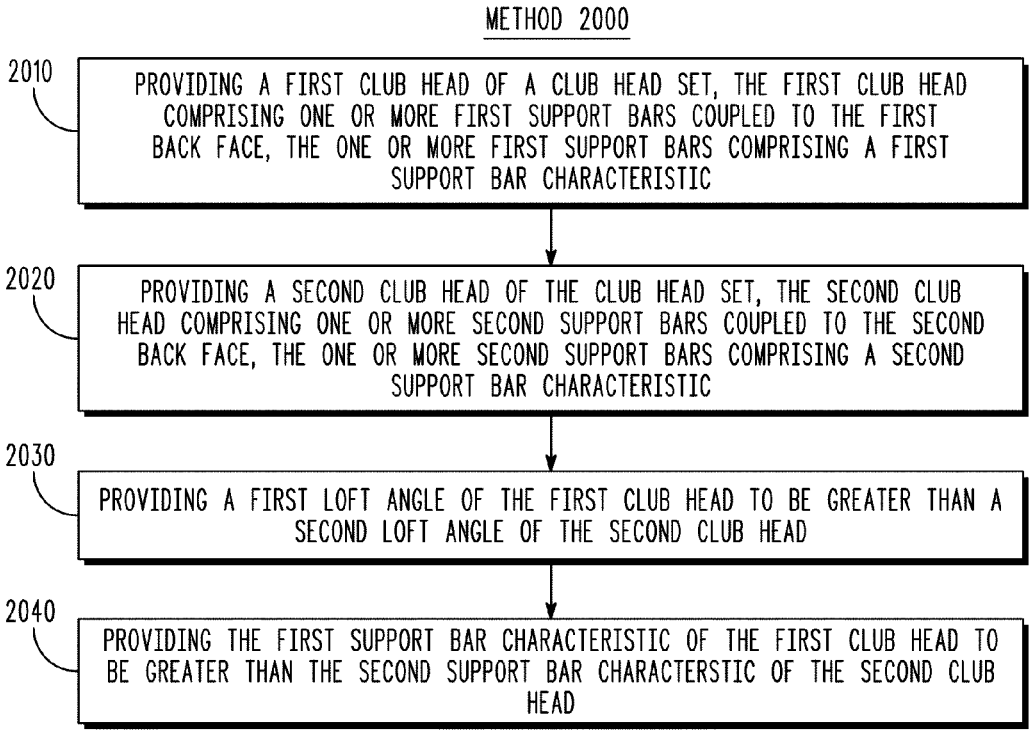
FIG. 20 illustrates a flowchart of a method for providing a club head set similar to the club head sets described for FIGS. 8-19.

Forging ahead, FIG. 20 illustrates a flowchart of method 2000 for providing a club head set. In some examples, the club head set of method 2000 can be similar to club head set 80 of FIGS. 8-16 and 18-19, and/or to club head set 171 of FIG. 17.

Block 2010 of method 2000 comprises providing a first club head of a club head set, the first club head comprising one or more first support bars coupled to the first back face, the one or more first support bars comprising a first support bar characteristic. In some examples, the first club head can be similar to club head 1200 (FIGS. 12, 15, 16, 19), and the one or more first support bars can be similar to support bars 1261 (FIG. 12) coupled to back face 1260, or to support bars 1761 (FIG. 17) coupled to back face 1760. In the same or other examples, the first support bar characteristic can comprise a support bar width, a support bar thickness, and/or a total number of support bars.

Block 2020 of method 2000 comprises providing a second club head of the club head set, the second club head comprising one or more second support bars coupled to the second back face, the one or more second support bars comprising a second support bar characteristic. In some examples, the second club head can be similar to club head 800 (FIGS. 8-10, 13, 16-19), and the one or more first support bars can be similar to support bars 861 (FIGS. 8, 12, 17) coupled to back face 860. In the same or other examples, the second support bar characteristic can comprise a second support bar width, a second support bar thickness, and/or a second total number of support bars.

Block 2030 of method 2000 comprises providing a first loft angle of the first club head to be greater than a second loft angle of the second club head. In some examples, the first loft angle can be similar to loft angle 1555 (FIG. 15) of club head 1200, and the second loft angle can be similar to loft angle 955 (FIGS. 9, 13) of club head 800.

Block 2040 of method 2000 comprises providing the first support bar characteristic of the first club head to be greater than the second support bar characteristic of the second club head. As a result, the support bar characteristic would be greater for the club head having a greater loft angle. As an example, the first support bar characteristic for club head 1200 in FIG. 12 comprises a support bar width of support bars 1261, while the second support bar characteristic for club head 800 in FIG. 10 comprises a support bar width of support bars 861. As can be seen by comparing FIGS. 8 and 12, and by referring to the graph in FIG. 16, the support bar width for support bars 1261 (FIG. 12) is greater than the support bar width for support bars 861 (FIG. 10) in the example of golf club set 80. In the same or another example, where the support bar characteristic comprised a support bar thickness, the support bar thickness for support bars 1261 (FIG. 12) can be thicker than the support bar thickness for support bars 861 (FIG. 10). In the example of FIG. 17, the support bar characteristics comprise a total number of support bars and, as can be seen by comparing club head 1703 against club head 800 in FIG. 17, the total number of support bars 1761 in club head 1703 comprises support bars 12611-12612 and 17613-17616, and is thus greater than the total number of support bars 861 in club head 800, which comprises support bars 8611-8612.

There can be examples where the description above for method 2000 can be extended throughout the two or more club heads of the club head set. For example, method 2000 could comprise providing two or more club heads of the club head set, and providing a support bar characteristic for each of the two or more club heads, the support bar characteristic incrementally varying across the two or more club heads in accordance with loft angle variation across the two or more club heads. In such an example, the two or more club heads comprise the first and second club heads of blocks 2010 and 2020. In addition, the support bar characteristic for the first club head could comprise the first support bar characteristic described above with respect to blocks 2010 and 2040, while the support bar characteristic for the second club head could comprise the second support bar characteristic described above with respect to blocks 2020 and 2040. In the same or other examples, providing the support bar characteristic for each of the two or more club heads can comprises incrementally varying the support bar characteristic across the two or more club heads for each incremental loft angle variation across the two or more club heads.

In some examples, method 2000 could comprise providing a hosel for a club head of the club head set, and providing a counterbalance weight located only at a lower toe section at a back portion of the club head to counterbalance the hosel. In some examples, a counterbalance weight can be provided for the first club head of block 2010, for the second club head of block 2020, and/or for several or all of the club heads of the golf club set of method 2000. In some examples, the counterbalance weight can be similar to lower toe insert 895 (FIGS. 8, 10, 13) and or to lower toe insert 1295 (FIGS. 12, 15).

There can also be examples of method 2000 where an insert can be provided and located in a cavity at a back portion of a club head. For instance, a first back portion of the first club head can further comprise a back wall extended between the heel and toe regions and a first cavity located between the first back face and the back wall. The first cavity can comprises a cavity heel zone, a cavity toe zone, a cavity center zone, a cavity inner wall located opposite the first back face, and a cavity outer wall located opposite the back wall. In addition, the cavity inner wall of the first cavity can be thicker, relative to the first front face, at the cavity heel and toe zones than at the cavity center zone. In some examples, the first cavity can be similar to cavity 1280 of club head 1200 (FIG. 12), which can also be similar to cavity 1080 of club head 800 (FIG. 10). Also, the first club head can further comprise a first insert comprising an insert heel zone, an insert toe zone and an insert center zone, where the first insert is configured to be at least partially housed in the first cavity, and each of the insert heel and toe zones are thinner than the insert center zone. The first insert can comprise an insert inner wall complementary to the cavity inner wall, such that the insert heel and toe zones are obtusely angled relative to each other along the insert inner wall and about the insert center zone, and/or such that the cavity inner wall is obtusely angled complementarily to the insert inner wall. In some examples, the first inset can be similar to insert 885, as described above for FIGS. 8, and 18. Such arrangements may beneficial, for example, to redistribute mass away from a center of the club head to augment the moment of inertia thereof, as described above with respect to insert 885 and cavity 1080 of club head 800 (FIGS. 8, 10).

In some examples, some of the blocks of method 2000 can be subdivided into one or more sub-blocks. For example, block 2010 can be subdivided into several sub-blocks as described above for providing different portions of the first club head, such as the cavity and the insert at the back portion thereof.

In the same or other examples, one or more of the different blocks of method 2000 can be combined into a single block or performed simultaneously, and/or the sequence of such blocks can be changed. For example, block 2030 can occur simultaneously with block 2010 for the first club head, and can occur simultaneously with block 2020 for the second club head. In addition, block 2040 can occur simultaneously with block 2030. In another example, all of the details of the first club head can be performed in a first block, and all of the details of the second club head can be performed in a second block.

There can also be examples where method 2000 can comprise further or different blocks. As an example, method 2000 can also comprise individual blocks similar to blocks 2010 and/or 2020 for each of the two or more club heads of the club head set of method 2000. Other variations can be implemented for method 2000 without departing from the scope of the present disclosure.

Figure 21:
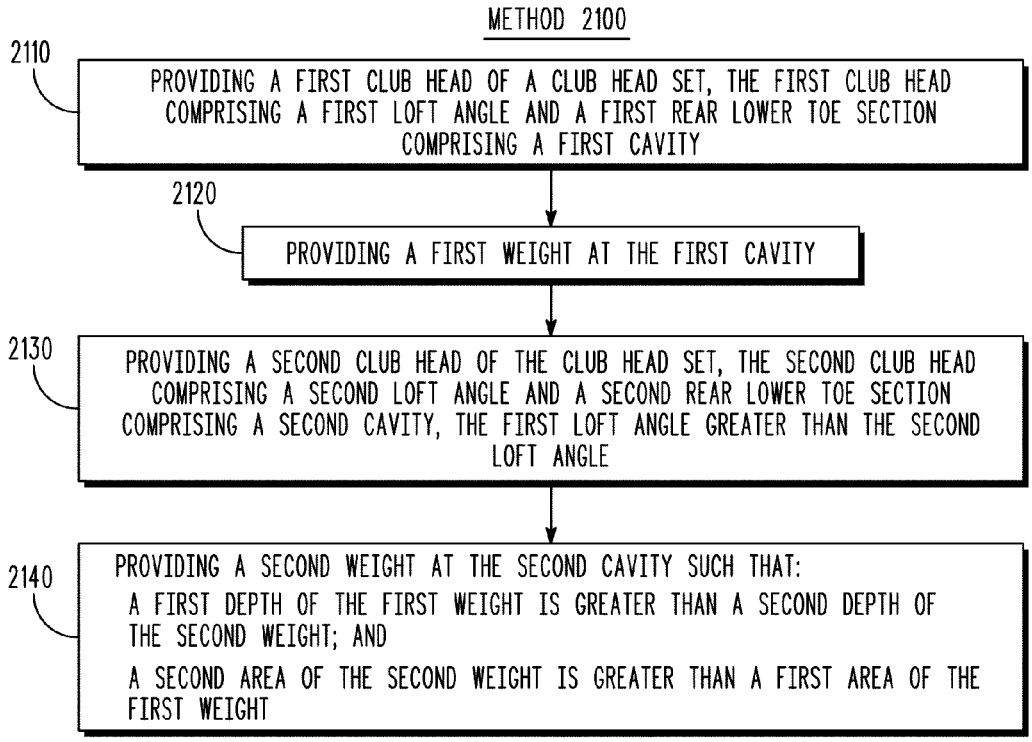
FIG. 21 illustrates a flowchart of another method for providing a club head set similar to the club head sets described for FIGS. 8-19 according to an embodiment of the golf clubs and methods of manufacture described herein.

Moving on, FIG. 21 illustrates a flowchart of method 2100 for providing a club head set. In some examples, the club head set of method 2100 can be similar to club head set 80 of FIGS. 1-16 and 19, and/or to club head set 171 of FIG. 17.

Block 2110 of method 2100 comprises providing a first club head of a club head set, the first club head comprising a first loft angle and a first rear lower toe section comprising a first cavity. In some examples, the first club head can be similar to club head 1200 (FIGS. 12, 15, 16, 19), such that the first loft angle can be similar to loft angle 1555 (FIG. 15), and the first cavity can be similar to cavity 1596 at lower toe section 1211 of club head 1200 (FIG. 15).

Block 2120 of method 2100 comprises providing a first weight at the first cavity. In some examples, the first weight can be similar to lower toe insert 1295 at cavity 1596 of club head 1200 (FIG. 15).

Block 2130 of method 2100 comprises providing a second club head of the club head set, the second club head comprising a second loft angle and a second rear lower toe section comprising a second cavity, the first loft angle greater than the second loft angle. There can be examples where the second club head can be similar to club head 800 (FIGS. 8, 9, 10, 13, 17, 18), such that the second loft angle can be similar to loft angle 955 (FIGS. 9, 13), and the second cavity can be similar to cavity 1396 at lower toe section 811 of club head 800 (FIG. 13). In other examples, the second club head can be another club head of the club head set having a loft angle less than the loft angle of the first club head.

Block 2140 of method 2100 comprises providing a second weight at the second cavity, such that a first depth of the first weight is greater than a second depth of the second weight, and a second area of the second weight is greater than a first area of the first weight. There can be examples where the second weight can be similar to lower toe insert 895 at cavity 1396 of club head 800 (FIG. 13). In such examples, the first depth and the first area of the first weight can be respectively similar to insert depth 15952 (FIG. 15) and insert area 12951 (FIG. 12), while the second depth and the second area can be respectively similar to insert depth 13952 (FIG. 13) and insert area 8951 (FIG. 10), and as a result, insert depth 15952 of lower toe insert 1295 is greater than insert depth 3952 of lower toe insert 895, and insert area 8951 of lower toe insert 895 is greater than insert area 12951 of lower toe insert 1295.

There can be implementations where the relationship above between the first and second areas of the first and second weights can be achieved by varying respective lengths and widths of the first and second weights. For example, the a second length of the second weight can be made greater than a first length of the first weight, and/or a second width of the second weight can be made greater than a first width of the first weight. In the example of club head set 80, where area 8951 (FIG. 10) is defined by length 8952 and width 8953 of lower toe insert 895, and where area 12951 (FIG. 12) is defined by length 12952 and width 12953, area 8951 of lower toe insert 895 can be greater than area 12951 of lower toe insert 1295 as a result of length 8952 being greater than length 12952, and/or as a result of width 8953 being greater than width 12953. In the present example, length 8952 and width 8953 of lower toe insert 895 are substantially the similar to each other, measuring approximately 0.475 inches (12.06 millimeters), while length 12952 and width 12953 of lower toe insert 1295 are also substantially similar to each other, measuring approximately 0.425 inches (10.8 millimeters). The corresponding length and width of lower insert weight 1195 (FIG. 11) measure approximately 0.450 inches (11.43 millimeters). There can be other embodiments, however, where the length and area of a lower toe insert need not be substantially similar to each other.

In some embodiments, block 2140 of method 2100 can further comprise providing a second minimum distance from the second weight to the second front face to be greater than a first minimum distance from the first weight to the first front face. In the same or other embodiments, block 2140 can also comprise providing a center of gravity of the first club head to be closer to the first front face than what a center of gravity of the second club head is to the second front face. For example, the second minimum distance can be similar to insert-to-face distance 1560 between lower toe insert 1295 and front face 1550 of club head 1200 (FIG. 15), while the first minimum distance can be similar to insert-to-face distance 1360 between lower toe insert 895 and front face 950 of club head 800 (FIG. 13). In the same or other embodiments, such arrangement may allow the center of gravity of higher-lofted club heads, like club head 1200, to be closer to their respective front faces than the center of gravity of lower lofted club heads like club head 800.

There can also be examples of method 2100 where an insert can be provided for location in a cavity at a back portion of a club head of the club head set of method 2100, similar to as described above for method 2000 and/or with respect to cavities 1080 (FIG. 10) and 1280 (FIG. 12) of club heads 800 and 1200, respectively, and inserts similar to insert 885 (FIG. 8, 18). For instance, the cavity inner wall of the cavity may be thinner at the cavity center zone than at the cavity heel and toe zones. Similarly, the insert center zone may be thicker than the insert heel and toe zones for said insert. Such arrangements may beneficial, for example, to redistribute mass away from a center of the club head to augment the moment of inertia thereof, as described above with respect to insert 885 and cavity 1080 of club head 800 (FIGS. 8, 10).

There also can be embodiments of method 2100 where the description above for can be extended throughout a portion or all of the two or more club heads of the club head set. For example, method 2100 could comprise providing two or more club heads of the club head set, and inversely varying the depth and area of the lower toe inserts as the loft angles of the respective club heads increase across the two or more club heads of the club head set.

In some examples, some of the blocks of method 2100 can be subdivided into one or more sub-blocks. For example, block 2110 can be subdivided into several sub-blocks as described above for providing different portions of the first club head, such as the cavity and the insert at the back portion thereof. As another example, block 2140 also can comprise providing a mass of the second weight to be substantially similar to a mass of the first weight. Similar provisions can also be made across method 2100 such that the masses of all lower toe inserts of the club head set are substantially similar to each other.

In the same or other examples, one or more of the different blocks of method 2100 can be combined into a single block or performed simultaneously, and/or the sequence of such blocks can be changed. For example, block 2110 can occur simultaneously with block 2120 for the first club head, and/or block 2130 can occur simultaneously with block 2140 for the second club head.

There can also be examples where method 2100 can comprise further or different blocks. As an example, method 2100 can also comprise individual blocks similar to blocks 2110 and/or 2120 for each of the two or more club heads of the club head set of method 2100. Other variations can be implemented for method 2100 without departing from the scope of the present disclosure.

Figure 24:
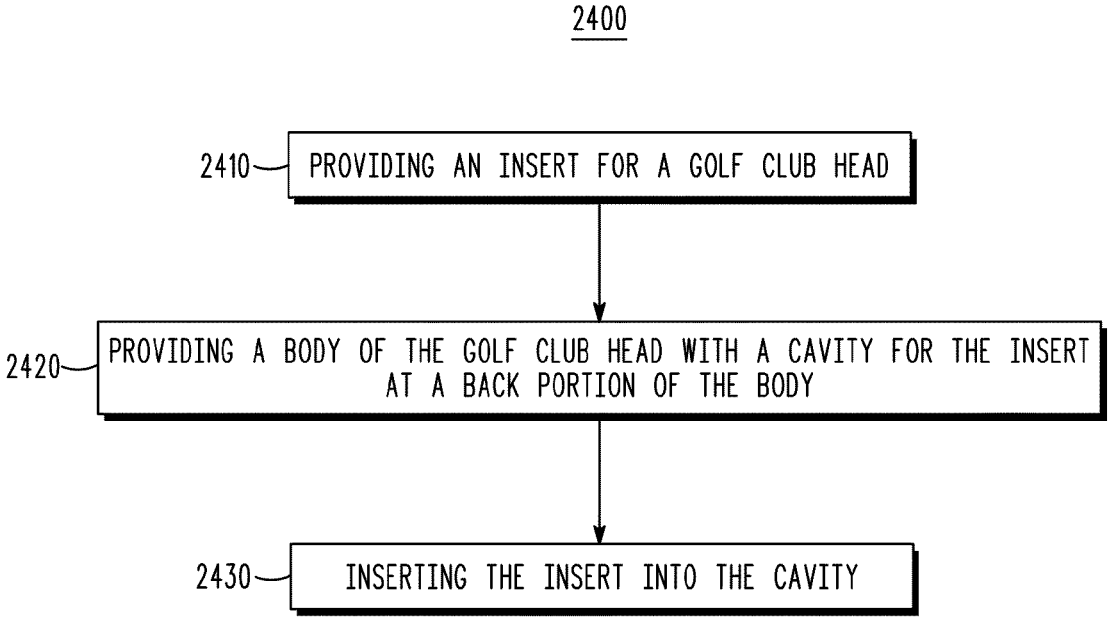
FIG. 24 illustrates a flowchart of a method for providing a club head similar to the club head shown in FIGS. 8-10, 13, and 18.

Skipping ahead, FIG. 24 illustrates a flowchart of method 2400 for providing a club head. In some examples, the club head of method 2400 can be similar to club head 800 as depicted for FIGS. 8-10 and 18.

Block 2410 of method 2400 comprises providing an insert for the golf club head of method 2400. In some examples, the insert can be similar to insert 185 (FIGS. 1, 3) and/or to insert 885 (FIGS. 8, 18). The insert can comprise heel, toe, and center zones, where the center zone is thicker than the heel and toe zones.

Block 2420 of method 2400 comprises providing a body of the golf club head with a cavity for the insert at a back portion of the body. Providing the body can comprise providing a back face and a back end at a back portion of the body, and providing the cavity between the back face and the back end. The cavity can comprise a cavity inner section adjacent to the back face, a cavity outer section opposite the back end, cavity heel and toe zones, and a cavity center zone thicker than the cavity heel and toe zones. In some examples, the body can be similar to body 801 of club head 800 (FIGS. 8, 18), the back face can be similar to back face 860 (FIGS. 8, 18), the back end can be similar to back end 870 (FIGS. 8, 18), and the cavity can be similar to cavity 1080 (FIGS. 10, 18).

Block 2430 of method 2400 comprises inserting the insert into the cavity of the body of the golf club head. In some examples, block 2430 can include adhering or otherwise coupling the insert to the cavity.

In some examples, some of the blocks of method 2400 can be subdivided into one or more sub-blocks. For example, block 2420 can be subdivided into several sub-blocks for providing different portions of the body of the club head.

In the same or other examples, one or more of the different blocks of method 2400 can be combined into a single block or performed simultaneously, and/or the sequence of such blocks can be changed. For example, block 2410 can occur simultaneously with or after block 2420 in some examples. In other examples one of blocks 2410 or 2420 may be optional. There can also be examples where method 2400 can comprise further or different blocks. Other variations can be implemented for method 2400 without departing from the scope of the present disclosure.

Figure 25:
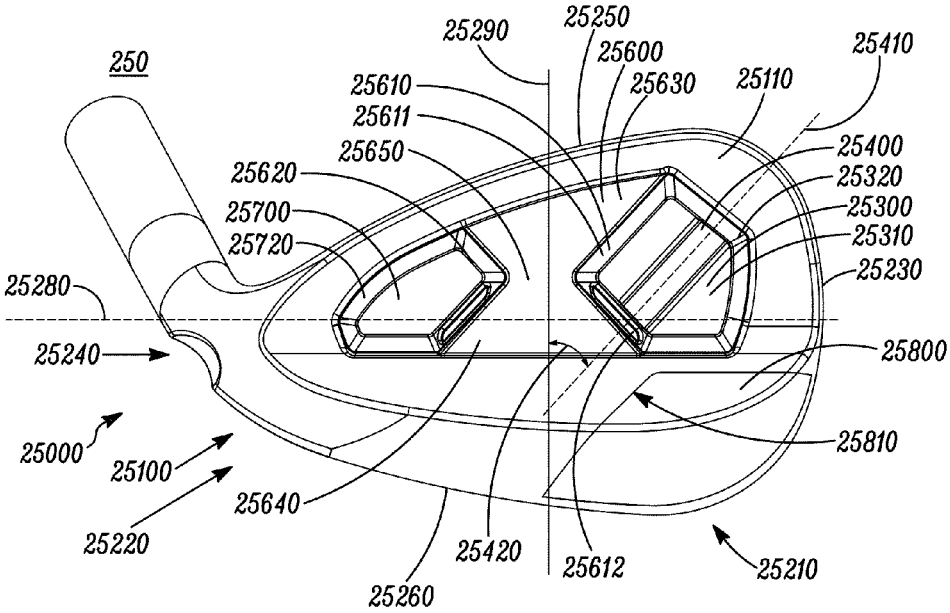
FIG. 25 illustrates a rear view of a club head of a club head set with varying characteristics according to an embodiment of the golf clubs and methods of manufacture described herein.
Figure 26:
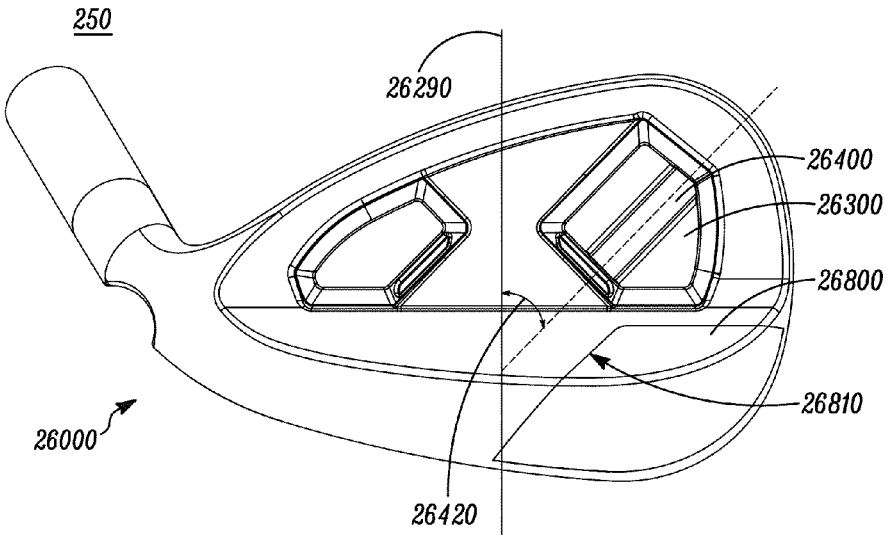
FIG. 26 illustrates a rear view of another club head of the club head set of FIG. 25.
Figure 27:
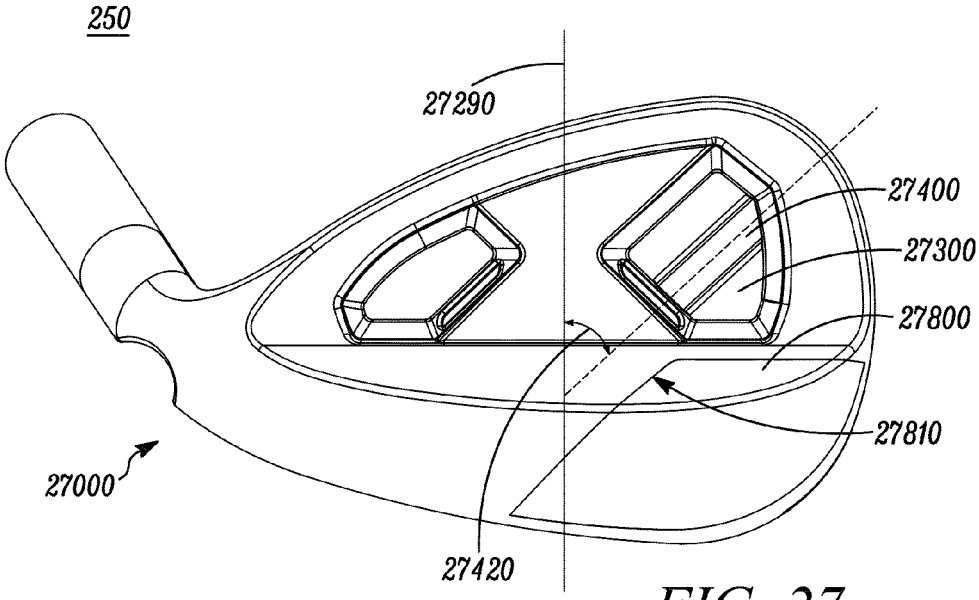
FIG. 27 illustrates a rear view of yet another club head of the club head set of FIG. 25.

Continuing with the figures, FIG. 25 presents a rear view of club head 25000 of club head set 250 according to an embodiment of the golf clubs and methods of manufacture described herein. FIG. 26 presents a rear view of club head 26000 of club head set 250, and FIG. 27 presents a rear view of club head 27000, also of club head set 250. Club head set 250 comprises one or more club heads, such as club heads 25000 (FIG. 25), 26000 (FIG. 26), and 27000 (FIG. 27), having respective diagonal stabilizing bars at their back faces. As will be described below, such diagonal stabilizing bars can be used for strengthening the club heads by reducing club head deformation and/or inhibiting vibrations with the club heads upon impact with a golf ball. In addition, in the same or other examples, such diagonal stabilizing bars may be angled, depending on the loft angle of the club heads, to be aligned with a strike path of the club head so as to better reinforce the club heads against deformation and/or absorb vibrations along expected impact points or paths, and/or to provide better desired directionality control for the impacted golf ball.

In the example of FIG. 25, club head 25000 is shown as a wedge iron head comprising back face 25100 opposite a strike face thereof. There can be other embodiments, however, where other types of club heads may be used, such as irons or iron-like club heads of higher or lower loft. Club head 25000 also comprises toe region 25210, heel region 25220, toe end 25230, heel end 25240, top rail or top end 25250, and sole or bottom end 25260. Vertical axis 25290 extends through top end 25250 and bottom end 25260, splitting club head 25000 between heel region 25220 and toe region 25210.

In the present example, back face 25100 of club head 25000 comprises cavity 25300 located at toe region 25210, where cavity 25300 comprises cavity base 25310, and cavity wall 25320 bounding at least a portion of cavity base 25310. Cavity base 25310 is sunk in relative to perimeter 25110 of back face 25100 in the present example, such that perimeter 25110 protrudes above cavity base 25310 and defines at least a portion of cavity wall 25320. There can be other examples, however, where cavity wall 25320 may not completely bound cavity base 25310, and/or where perimeter 25110 may not protrude above cavity base 25310. In some embodiments, perimeter 25110 is a perimeter weight, and/or cavity 25300 is located within or below a larger rear cavity defined by perimeter 25110. Although cavity 25300 is located only at toe region 25210 in the present embodiment, there can be other embodiments where cavity 25300 may extend at least partially into heel region 25220

Back face 25100 also comprises stabilizing bar 25400 protruded from cavity base 25310 and extending diagonally relative to vertical axis 25290. The length of stabilizing bar 25400 may extend fully or partially across cavity base 25310, depending on the embodiment. As seen in FIG. 25, bar axis 25410 extends along a length of stabilizing bar 25400, being intersected with vertical axis 25290, and extending therefrom to the high toe portion of back face 25100, towards toe end 25230 and top end 25250. In some examples, a thickness or height of stabilizing bar 25400 from cavity base 25310, and/or of other stabilizing bars of club head set 250, may be of approximately 0.010 inch to approximately 0.25 inch. In the same or other examples, a width of stabilizing bar 25400, and/or of other stabilizing bars or other club heads of club head set 250, may be of approximately 0.050 inch to approximately 0.75 inch. In the same or other examples, the thickness or width of stabilizing bar 25400 may vary along its length, such as to increase or decrease towards the high toe portion of back face 25100. In the present example, bar axis 25410 is angled at bar angle 25420 of approximately 43 degrees relative to vertical axis 25290. There can be embodiments where the angle between vertical axis 25290 and bar axis 25410 may range from approximately 40 degrees to approximately 50 degrees. Depending on the club head, other club heads of club head set 250 may comprise bar angles, similar to bar angle 25420, of approximately 25 degrees to approximately 65 degrees between their respective vertical and bar axes.

Figure 28:
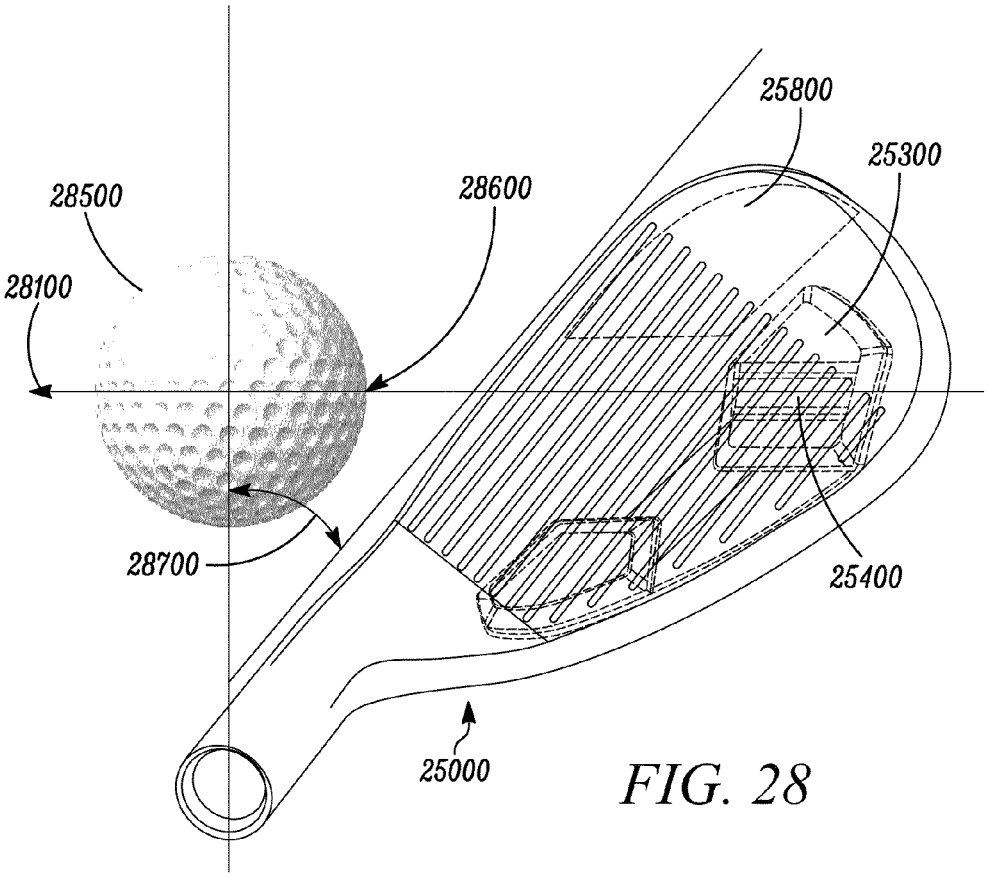
FIG. 28 illustrates a top "x-ray" view of the club head of FIG. 25 poised to strike a golf ball.

Skipping ahead in the figures, FIG. 28 illustrates a top x-ray view of club head 25000 along strike path 28100 and poised to strike golf ball 28500. In the present example, stability bar 25400 is angled at bar angle 25420 (FIG. 25), relative to vertical axis 25290 (FIG. 25), such that bar axis 25410 (FIG. 25) is substantially aligned with strike path 28100 when club head 25000 is proximate to impact point 28600 with golf ball 28500. As a result, stability bar 25400 is better positioned to receive, attenuate, and/or dissipate impact stresses and/or frequencies along its length upon impact with golf ball 28500 than if stability bar 25400 were aligned, for example, parallel or perpendicular to vertical axis 25290 (FIG. 25). In addition, because the length of stability bar 25400 is aligned substantially parallel with strike path 28100, when viewed from the top view of FIG. 28, stability bar 25400 may impart further consistency and directionality control to compel alignment of a flightpath of golf ball 2500 with strike path 28100.

As can be seen from the top view of FIG. 28, stability bar 25400 is angled to be substantially aligned with flight path 28100 when club head 25000 is at a target open face impact angle 28700 while proximate to impact point 28600. In some examples, one or more club heads may have stability bars similar to stability bar 25400, angled for substantial alignment with flight path 28100 for target open face impact angles of approximately 30 degrees to approximately 50 degrees. There also can be other examples, however, where stability bars could instead be angled such as to be aligned with flight path 28100 when their club heads are square or are at closed face impact angles when proximate to impact point 28600.

Backtracking to FIG. 26, club head 26000 comprises vertical axis 26290 similar to vertical axis 25290 (FIG. 25) of club head 25000 (FIG. 25), and stabilizing bar 26400 at cavity 26300, similar to stabilizing bar 25400 (FIG. 25). Stabilizing bar 26400 is angled, relative to vertical axis 26290, at bar angle 26420. FIG. 27 shows club head 27000 comprising vertical axis 27290 similar to vertical axis 25290 (FIG. 25) of club head 25000 (FIG. 25), and stabilizing bar 27400 at cavity 27300, similar to stabilizing bar 25400 (FIG. 25). Stabilizing bar 27400 is angled, relative to vertical axis 27290, at bar angle 27420.

The club heads in FIGS. 25-27 are each part of club head set 250, but differ from each other by comprising different lofts. In the present example, the loft of club head 27000 (FIG. 27) is greater than the loft of club head 26000 (FIG. 26), and the loft of club head 26000 (FIG. 26) is greater than the loft of club head 25000 (FIG. 25). Club head set 250 is configured such that the bar angles of its club heads vary based on the loft of its clubs. For example, bar angle 27420 (FIG. 27) is greater than bar angle 26420 (FIG. 26), and bar angle 26420 (FIG. 26) is greater than bar angle 25420 (FIG. 25). Accordingly, stabilizing bar 26400 (FIG. 26) will be substantially aligned with strike path 28100 (FIG. 28) when club head 26000 is at a target open face impact face angle greater than target open face impact angle 28700 (FIG. 28) of club head 25000 (FIG. 25). Similarly, stabilizing bar 27400 (FIG. 27) will be substantially aligned with strike path 28100 (FIG. 28) when club head 27100 is at a target open face impact angle greater than the target open face impact angle described above for club head 26000 (FIG. 26).

Consistent with the description above, in the present example, club head 25000 (FIG. 25) comprises a loft of approximately 52 degrees, comprises bar angle 25420 of approximately 43 degrees, and is configured for a target open face impact angle 28700 of approximately 37 degrees. Club head 26000 (FIG. 26) comprises a loft of approximately 56 degrees, comprises bar angle 26420 of approximately 44 degrees, and is configured for a target open face impact angle of approximately 38 degrees. Club head 27000 (FIG. 27) comprises a loft of approximately 60 degrees, comprises bar angle 27420 of approximately 47 degrees, and is configured for a target open face impact angle 28700 of approximately 42 degrees.

In the same or other embodiments, club head set 250 may comprise, in addition to, or instead of one or more of club heads 25000, 26000, and/or 27000, other club heads with different loft angles and corresponding characteristics. For instance, club head set 250 may comprise club heads with lofts of 50, 54, and/or 58 degrees, and/or lower lofted irons, with corresponding bar angle and target open face impact angle characteristics.

Several ranges can be implemented for the values described above. For example, there can be embodiments where club head 25000 (FIG. 25), club head 26000 (FIG. 26), club head 27000 (FIG. 27), and/or another club head of club head set 250 can comprise a loft of approximately 45 degrees to approximately 70 degrees, can comprise a bar angle of approximately 40 degrees to approximately 50 degrees, and/or can be configured for a target open face impact angle of approximately 30 degrees to approximately 50 degrees. In the same or other embodiments, where lower lofted irons are included, the lofts may range from approximately 18 degrees to approximately 70 degrees, and the bar angles may range from approximately 25 degrees to 65 degrees.

As can be seen in FIGS. 25-27, the club heads of club head set 250 comprise hourglass supports towards the middle of their respective back faces. As an example, club head 25000 comprises hourglass support 25600 protruding from back face 25100, where hourglass support 25600 comprises top portion 25630, bottom portion 25640, and middle portion 25650. Hourglass support 25600 also comprises toe sidewall 25610 and heel sidewall 25620, defining top portion 25630, bottom portion 25640, and middle portion 25650 therebetween. In the present example, cavity wall 25320 comprises toe sidewall 25610, such that toe sidewall 25610 protrudes above cavity base 25310. Also in the present example, the cavity wall 25720 of cavity 25700 comprises heel sidewall 25620, such that heel sidewall 25620 protrudes above the cavity base of cavity 25700

Hourglass support 25600 can be configured to provide several benefits to club head 25000. For example, by splitting the majority of its mass between top portion 25630 and bottom portion 25640, middle portion 25650 is made relatively lighter. Such an arrangement provides for improved moment of inertia about middle portion 25650 to improve stability on center impact hits at the strike face opposite middle portion 25650, and/or opposite cavities 25300 or 25700. In addition, the mass of the top portion of the hourglass support, located high on club head 25000, can be beneficial for positioning the center of gravity for optimal launch conditions and increasing moment of inertia. In some examples, middle portion 25650 of hourglass support 25600 can be located above a horizontal centerline 25280 of back face 25100, thereby further raising the center of gravity of club head 25000. Raising the center of gravity as described via hourglass support 25600 may provide for better launch control, permitting lower launch angles, and/or increased gear effect and ball spin, for a more stable golf ball flight path. In the same or other embodiments, top portion 25630 can be wider and/or thicker than bottom portion 25640 of hourglass support 25600.

Toe sidewall 25610 of hourglass support 25600 comprises top segment 25611 that defines, at least in part, top portion 25630 of hourglass support 25600. In the same or other examples, top segment 25611 is substantially parallel to stability bar 25400. Such parallel relationship may permit top segment 25611, and/or other parts of hourglass support 25600, to act in conjunction with stability bar 25400 to better receive, attenuate, and/or dissipate impact stresses, vibrations, and/or frequencies, and/or to assist in imparting better golf ball directionality control when aligned relative to strike path 28100 (FIG. 8). Toe sidewall 25610 also comprises bottom segment 25612 in the present example, defining at least in part bottom portion 25640 of hourglass support 25600. In some examples, bottom segment 25612 can be substantially perpendicular to stability bar 25400, and/or can be otherwise angled relative thereto.

Toe sidewall 25610 is substantially non-linear along middle portion 25650 of hourglass support 25600 in the present embodiment. In particular, in the present example, toe sidewall 25610 is angled thereat, approximating a "U" or "V" shape, such that an angle of approximately 80 degrees to approximately 100 degrees can exist between top portion 25611 and bottom portion 25612 of toe sidewall 25610.

In the present example, back face 25100 also comprises cavity 25700 located at heel region 25220. Cavity 25700 can be similar to cavity 25300, but comprises cavity wall 25720 which includes heel sidewall 25620 of hourglass support 25600. In FIG. 25, both of cavities 25700 and 25300 are located above horizontal centerline 25280. In the present example, cavity 25700 is devoid of a stabilizing bar similar to stabilizing bar 25400. There may be other embodiments, however, where a stabilizing bar could be provided at cavity 25700, such as for club heads configured for closed face impact angles. In such examples where a stabilizing bar is provided at cavity 25700, such stability bar may be parallel to a top segment of heel sidewall 25620 of hourglass support 25600, parallel to the angle of stability bar 25400, substantially perpendicular to the angle of stability bar 25400, and/or otherwise angled, such as in alignment with a strike path of its club head while at a target face impact angle. In the same or other examples, where cavity 25700 comprises a stability bar, cavity 25300 may or may not comprise stability bar 25400.

As can be seen in FIGS. 25-27, the club heads of club head set 250 also comprise respective toe weights that can vary depending on the loft angle of their club heads. For example, in FIG. 25, club head 25000 comprises toe weight 25800 located at toe region 25210 towards bottom end 25260. Toe weight 25800 comprises weight surface 25810 facing towards heel region 25240, where weight surface 25810 is angled relative to vertical axis 25290. Similarly, in FIG. 26, club head 26000 comprises toe weight 26800 with weight surface 26810 angled relative to vertical axis 25290, and in FIG. 27, club head 27000 comprises toe weight 27800 with weight surface 27810 angled relative to vertical axis 27290. In the present example of club head set 250, the angles of weight surfaces 25810 (FIG. 25), 26810 (FIG. 26), and 27810 (FIG. 27) vary in accordance with the loft of their respective club heads, similar to the variation described above with respect to the angles of stability bars 25400 (FIG. 25), 26400 (FIG. 26) and 27400 (FIG. 27). For example, where the loft of club head 27000 is greater than the loft of club head 26000 and where the loft of club head 26000 is greater than the loft of club head 25000, the angle of weight surface 27810 relative to the vertical axis is greater than the angle of weight surface 26810 relative to the vertical axis, and the angle of weight surface 26810 relative to the vertical axis is greater than the angle of weight surface 25810 relative to the vertical axis. In the present example, the angled weight surfaces are aligned substantially parallel to their corresponding stabilizing bars, such that weight surface 25810 is substantially parallel to stabilizing bar 25400 (FIG. 25), weight surface 26810 is substantially parallel to stabilizing bar 26400 (FIG. 26), and weight surface 27810 is substantially parallel to stabilizing bar 27400 (FIG. 27). In the same or other examples, such variation in the angles of the weight surfaces can provide benefits similar to those described above with respect to the variation between stabilizing bars 25400 (FIG. 25), 26400 (FIG. 26), and 27400 (FIG. 27), such as by aligning weight surfaces 25810, 26810, 27810 with respective strike paths when their club heads are at respective target face impact angles. There may be other examples, however, where club heads of a club head set similar to club head set 250 need not comprise respective toe weights, or may comprise respective toe weights that do not necessarily vary depending on the loft angle of their club heads.

Figure 29:
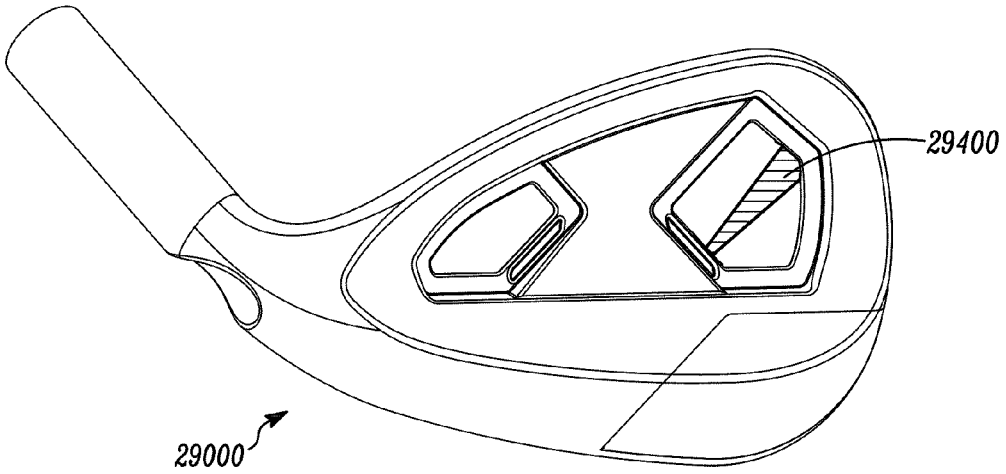
FIG. 29 illustrates a rear view of a club head similar to that of FIG. 25 and with a varying stabilizing bar.

Continuing with the figures, FIG. 29 illustrates a rear view of club head 29000. Club head 29000 can be similar to club head 25000 (FIG. 25), but comprises stabilizing bar 29400. Stabilizing bar 29400 is similar to stabilizing bar 25400 (FIG. 25), but increases in width towards a top toe end of club head 29000. In the same or other examples, stabilizing bar 29400 can also, or alternatively, increase in thickness towards the top toe end of club head 29000. In some examples, increasing the width or thickness of the stabilizing bar towards the top toe end of the club head can provide additional structural support to the high toe region thereof, and/or provide further reinforced area along a broader path aligned for impact with a golf ball. Such reinforcement can further reduce deformation and absorb further stresses at impact. Additionally, the increase width and/or thickness can position the center of gravity of the club head higher for increased spin rate and greater moment of inertia.

Figure 30:
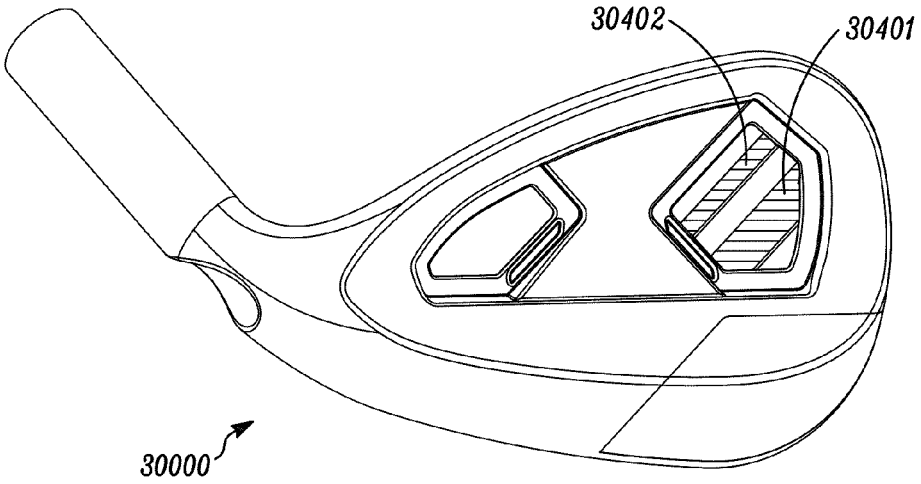
FIG. 30 illustrates a rear view of a club head similar to that of FIG. 25 and with a plurality of stabilizing bars.

FIG. 30 illustrates a rear view of club head 30000. Club head 30000 is similar to club head 25000 (FIG. 25), but comprises stabilizing bars 30401 and 30402 rather than just a single stabilizing bar like stabilizing bar 25400 (FIG. 25). In the present example, stabilizing bars 30404 and 30402 are angled as described above for stabilizing bar 25400 (FIG. 25), but stabilizing bar 30401 is wider than stabilizing bar 30402, and is located closer to the toe end of club head 30000 than stabilizing bar 30402. In the same or other examples, stabilizing bar 30401 can be thicker or taller in addition to, or instead of, wider than stabilizing bar 30402. Similarly, in the same or other examples, the widths of stabilizing bar 30401 and 30402 can be the same. In some embodiments, additional stabilizing bars can provide further structural support across the toe region of club head. While a single stabilizing bar provides reinforcement at a particular location, added bars can increase support over a larger cross section of the face.

Figure 31:
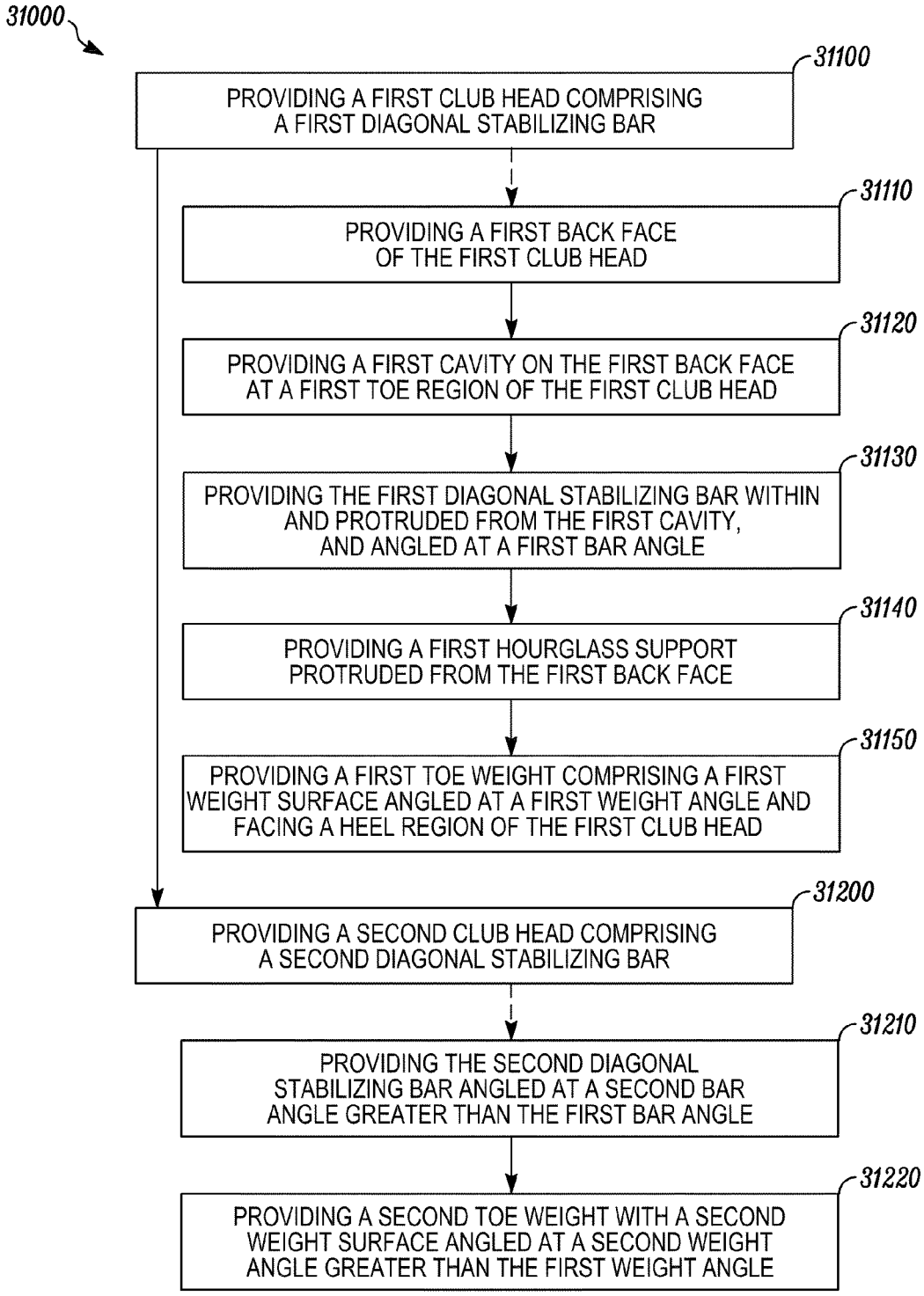
FIG. 31 illustrates a flowchart of a method for providing a club head set in accordance with FIGS. 25-30.

Moving along, FIG. 31 illustrates a flowchart of method 31000 for providing a golf club head set. In some examples, the golf club head set of method 31000 can be similar to golf club head set 250 described with respect to FIGS. 25-28, and/or to a golf club head set comprising club heads similar to those of FIGS. 29 and/or 30. The golf club head set may comprise one or more club heads comprising diagonal stabilizing bars.

Block 31100 of method 31000 comprises providing a first club head comprising a first diagonal stabilizing bar. In some examples, the first club head can be similar to one of the club heads of club head set 250 described above, such as club head 25000 (FIG. 25), club head 29000 (FIG. 29), or club head 30000 (FIG. 30). A first vertical axis may be defined to extend through first top and first bottom ends of the first club head, and between first heel and first toe regions of the first club head. In some examples, the first vertical axis can be similar to vertical axis 25290 (FIG. 25), and the first toe region can be similar to toe region 25210 (FIG. 25).

Block 31100 can comprise sub-block 31110, in some examples, for providing a first back face of the first club head. As an example, the first back face can be similar to back face 25100 of club head 25000 (FIG. 25). The first back face can be located opposite a first strike face of the first club head. The first club head may be provided, for example, via a casting or forging process.

Next, block 31100 can comprise sub-block 31120 for providing a first cavity on the first back face at the first toe region of the first club head. The first cavity can be similar to first cavity 25300 (FIG. 25), and may comprise a first cavity base similar to cavity base 25310, and a first cavity wall bounding the first cavity base and similar to cavity wall 25320 (FIG. 25). In some examples, a perimeter of the first club head may protrude above the first cavity base and/or define a portion of the first cavity wall, such as seen in FIG. 25 with respect to perimeter 25110 protruding above cavity base 25310. In the same or other examples, the first back face may be configured such that the first cavity is located only at the first toe region of the first club head.

Block 31100 of method 31000 can also comprise sub-block 31130 for providing the first diagonal stabilizing bar within and protruded from the first cavity, and angled at a first bar angle relative to a vertical axis of the first club head. The first diagonal stabilizing bar may be similar to stabilizing bar 25400 (FIG. 25), and may comprise a first bar axis extending along a length of the first bar, similar to bar axis 25410 (FIG. 25). The first bar axis can be aligned to intersect the first vertical axis, and to extend therefrom towards a high toe portion of the first club head. In some examples, the first diagonal stabilizing bar may be forged or cast with the first club head, and/or may be machined therefrom. There can be other examples where the first diagonal stabilizing bar does not comprise a single piece of material with the first back face.

There can be embodiments where the first bar axis can be angled at the first bar angle such that the first bar axis can be substantially aligned with a strike path of the first club head when the first club head is proximate to an impact point with a golf ball along the strike path. In some examples, such alignment of the first bar axis and/or the first stabilizing bar can be as described above with respect to FIG. 28 for stabilizing bar 25400 relative to strike path 28100. In the same or other examples, the alignment of the first bar axis and/or of the first stabilizing bar can be configured with respect to target face impact angles as described above with respect to the club heads of FIGS. 25-28.

There can also be embodiments with other configurations for the first diagonal stabilizing bar. As an example, in some embodiments, at least one of a thickness or a width of the first diagonal stabilizing bar may be configured to increase towards the first top end of the first club head, as described above with respect to FIGS. 25 and 29. As another example, a second diagonal stabilizing bar may be located in the first cavity, parallel to the first diagonal stabilizing bar, as described with respect to FIG. 30. In such examples, the second diagonal stabilizing bar may be thicker and/or wider than the first diagonal stabilizing bar, and can be located closer to the first toe end of the first club head than the first diagonal stabilizing bar.

In some examples, block 31100 may further comprise sub-block 31140 for providing a first hourglass support protruded from the first back face. There can be examples where the first hourglass support may be similar to hourglass support 25600 (FIG. 25). The first hourglass support may be machined at the first back face in some examples, but there can also be examples where the first hourglass support need not comprise a single piece of material with the first back face. In some implementations, the first hourglass support may comprise top, bottom, and middle portions that may be respectively similar to top portion 25630, bottom portion 25640, and/or middle portion 25650 of hourglass support 25600 (FIG. 25). The first hourglass support may also comprise heel and toe hourglass sidewalls, which may be respectively similar to heel sidewall 25620 and/or toe sidewall 25610 of hourglass support 25600 (FIG. 25). In some embodiments, the toe hourglass sidewall may protrude above the first cavity of block 31120, and/or may comprise a portion of the first cavity wall. There can also be examples where a top segment of the toe hourglass sidewall can be substantially parallel to the first bar axis of the first diagonal stabilizing bar. In the same or other examples, the toe hourglass sidewall can be non-linear along the middle hourglass portion of the first hourglass support, as seen for toe sidewall 25610 in FIG. 25. In the same or other embodiments, the heel hourglass sidewall may protrude above a second cavity of the first club head. For example, such second cavity can be located at the heel region of the first club head, and/or can be similar to cavity 25700 (FIG. 25) in some embodiments.

Block 31100 may comprise, in some embodiments, sub-block 31150 for providing a first toe weight comprising a first weight surface angled at a first weight angle and facing a heel region of the first club head. The first toe weight can be located at the first toe region and towards the first bottom end of the first club head, and the first weight surface can face towards the first heel region at a first weight angle relative to the first vertical axis of the first club head. In some examples, the first toe weight can be similar to toe weight 25800, and the first weight surface can be similar to weight surface 25810 (FIG. 25). In the same or other example, the first toe weight can be similar to insert 895 (FIG. 8), such as by comprising similar material(s).

In some examples, method 31000 can comprise block 31200 for providing a second club head comprising a second diagonal stabilizing bar. The second club head can be similar, in some examples to another one of the club heads of club head set 250, such as one of club heads 26000 (FIG. 26) or 27000 (FIG. 27).

Block 31200 comprises sub-block 31210 for providing the second diagonal stabilizing bar angled at a second bar angle greater than the first bar angle. In some examples, the loft of the second club head of block 31200 can be greater than the loft of the first club head of block 31100, such that bar angles increase with increasing lofts. In some embodiments, the second diagonal stabilizing bar can be similar to stabilizing bar 26400 at bar angle 26420 (FIG. 26)

Block 31200 can also comprise, in some examples, sub-block 31220 for providing a second toe weight with a second weight surface angled at a second weight angle greater than the first weight angle. There can be embodiments where the second toe weight can be similar to toe weight 26800 with weight surface 26810.

In some examples, one or more of the different blocks of method 31000 can be combined into a single block or performed simultaneously, and/or the sequence of such blocks can be changed. For example, sub-blocks 31120 and 31130 may be carried out concurrently with sub-block 31110 in some examples, such as when casting, forging, and/or machining the first club head. In the same or other examples, some of the blocks of method 31000 can be subdivided into several sub-blocks. For example, sub-block 31150 may comprise a sub-block for coupling the first toe weight to the first club head, such as by welding or via adhesives. There can also be examples where method 31000 can comprise further or different blocks. As an example, another block similar to block 31100 and/or corresponding sub-blocks 31110, 31120, 31130, 31140, and/or 31150 may be provided for providing a third club head comprising a third diagonal stabilizing bar, such as for club head 27000 (FIG. 27) or other club heads of club head set 250. In addition, there may be examples where method 31000 can comprise only part of the steps described above. For instance, sub-block 31150 may be optional in some embodiments. Other variations can be implemented for method 31000 without departing from the scope of the present disclosure. Although the club head sets with varying characteristics and related methods have been described with reference to specific embodiments, various changes may be made without departing from the spirit or scope of the disclosure. Additional examples of such options and other embodiments have been given in the foregoing description. Accordingly, the disclosure herein of embodiments of club head sets with varying characteristics and related methods is intended to be illustrative of the scope of the present disclosure and is not intended to be limiting. For example, in one embodiment, a golf club head may have one or more features of FIGS. 1-5, with or without the other features described with reference to FIGS. 1-5. In another example, the club head sets described above with respect to FIGS. 8-21 may comprise more or less club heads than those listed in FIGS. 16 and 19, and the loft angles, support bar characteristics, and/or lower toe insert weight attributes may differ from those in the examples of FIGS. 8-21 while still being related to each other. As yet another example, club heads in accordance with the implementations discussed for FIGS. 25-31 may have corresponding stabilizing bars of several shapes, such as rectangular, triangular, trapezoidal, circular, crescent, and/or rhomboid shapes, and/or may have corresponding stabilizing bars of several patterns, such as solid, waffle, dimpled, honeycomb, growth, and/or reduction patterns, while still embracing the teachings of the present disclosure. Other permutations of the different embodiments having one or more of the features of the various figures are likewise contemplated. It is intended that the scope of the club head sets with varying characteristics and related methods shall be limited only to the extent required by the appended claims.

The club head sets with varying characteristics and related methods discussed herein may be implemented in a variety of embodiments, and the foregoing discussion of these embodiments does not necessarily represent a complete description of all possible embodiments. Rather, the detailed description of the drawings, and the drawings themselves, disclose at least one preferred embodiment, and may disclose additional embodiments.

All elements claimed in any particular claim are essential to the club head sets with varying characteristics and related methods claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A golf club head set comprising:

a first club head comprising:

a first strike face;

a first back face opposite the first strike face;

a first top end;

a first bottom end opposite the first top end;

a first toe end;

a first toe region comprising the first toe end;

a first heel end opposite the first toe end;

a first heel region comprising the first heel end; and a first vertical axis extended substantially perpendicularly to a horizontal centerline of the first back face, located approximately mid-way between the first toe end and the first heel end, extended through the first top end and the first bottom end, and demarcating the first heel region from the first toe region;

wherein:

the first back face comprises:

a perimeter weight extending along at least the first top end and the first bottom end of the first club head;

a first hourglass support traversed by the first vertical axis and extended entirely from a top portion of the perimeter weight to a bottom portion of the perimeter weight;

a first cavity located only at the first toe region and comprising:

a first cavity base; and a first cavity wall bounding at least a portion of the first cavity base; and a first bar within the first cavity and comprising a first bar axis extending throughout a length centerline of the first bar;

the first bar protruded from the first cavity base and extending diagonally, relative to the first vertical axis, across at least a first portion of the first cavity; and the first bar axis intersected with the first vertical axis and extending therefrom towards the first toe end and the first top end;

the first hourglass support comprises:

top and bottom hourglass portions;

a middle hourglass portion narrower than the top and bottom hourglass portions; and heel and toe hourglass sidewalls defining the top, middle, and bottom hourglass portions of the first hourglass support therebetween;

the perimeter weight protrudes above the first cavity base and defines one portion of the first cavity wall at the first toe region;

the first hourglass support protrudes above the first cavity base and defines another portion of the first cavity wall at the first toe region; and a minimum thickness of the first cavity wall protruded above the first cavity base is greater than a maximum thickness of the first bar protruded above the first cavity base.

2. The golf club head set of claim 1, wherein:

the toe hourglass sidewall of the first hourglass support protrudes above the first cavity base; and the first cavity wall comprises the toe hourglass sidewall of the first hourglass support.

3. A golf club head set comprising:

a first club head comprising:

a first strike face;

a first back face opposite the first strike face;

a first top end;

a first bottom end opposite the first top end;

a first toe end;

a first toe region comprising the first toe end;

a first heel end opposite the first toe end;

a first heel region comprising the first heel end; and a first vertical axis extended substantially perpendicularly to a horizontal centerline of the first back face, located approximately mid-way between the first toe end and the first heel end, extended through the first top end and the first bottom end, and demarcating the first heel region from the first toe region;

wherein:

the first back face comprises:

a perimeter weight extending along at least the first top end and the first bottom end of the first club head;

a first hourglass support traversed by the first vertical axis and extended entirely from a top portion of the perimeter weight to a bottom portion of the perimeter weight;

a first cavity located only at the first toe region and comprising:

a first cavity base; and a first cavity wall bounding the first cavity base;

and a first bar within the first cavity, protruded from the first cavity base and comprising:

a first bar axis extending along an entire length centerline of the first bar; and a first bar upper angle between the first vertical axis and the first bar axis;

the first hourglass support is protruded from the first back face and comprises:

top and bottom hourglass portions;

a middle hourglass portion narrower than the top and bottom hourglass portions; and heel and toe hourglass sidewalls defining the top, middle, and bottom hourglass portions of the first hourglass support therebetween;

the perimeter weight protrudes above the first cavity base and defines one portion of the first cavity wall at the first toe region;

the toe hourglass sidewall of the first hourglass support protrudes above the first cavity base and defines another portion of the first cavity wall at the first toe region; and a minimum thickness of the first cavity wall protruded above the first cavity base is greater than a maximum thickness of the first bar protruded above the first cavity base.

4. The golf club head set of claim 1, wherein:

the first bar upper angle is approximately 25 degrees to approximately 65 degrees.

5. The golf club head set of claim 3, wherein:

the first bar axis is angled at the first bar upper angle, relative to the first vertical axis, such that the first bar axis is substantially aligned with a strike path of the first club head when the first club head is proximate to an impact point with a golf ball along the strike path.

6. The golf club head set of claim 5, wherein:

the first club head is configured for a first target open face impact angle; and the first bar axis is angled at the first bar upper angle to be substantially aligned with the strike path when the first club head is at the first target open face impact angle while proximate to the impact point.

7. The golf club head set of claim 3, further comprising:

a second club head comprising a second top end, a second vertical axis, and a second bar with a second bar axis;

wherein:

the second bar axis extends diagonally, relative to the second vertical axis, throughout a length centerline of the second bar;

the second bar comprises a second bar upper angle extended between the second vertical axis and the second bar axis;

a second loft angle of the second club head is greater than a first loft angle of the first club head;

at least the second club head comprises at least one of:

a wedge club head type; or the second loft angle of at least approximately 42 degrees;

the first bar upper angle and the second bar upper angle are acute; and the second bar upper angle is greater than the first bar upper angle.

8. The golf club head set of claim 7, further comprising:

a third club head comprising a third top end, a third vertical axis and a third bar with a third bar axis;

wherein:

the third bar axis extends diagonally, relative to the third vertical axis, throughout a length centerline of the third bar;

the third bar comprises a third bar upper angle extended between the third vertical axis and the third bar axis;

the second club head is configured for a second target open face impact angle greater than a first target open face impact angle of the first club head;

the third club head is configured for a third target open face impact angle greater than the second target open face impact angle;

a third loft angle of the third club head is greater than the second loft angle of the second club head;

the third bar upper angle is acute;

the third bar upper angle is greater than the second bar upper angle;

the first, second, and third loft angles range between approximately 18 degrees to approximately 70 degrees;

the first, second, and third bar upper angles range between approximately 25 degrees to approximately 65 degrees; and the first, second, and third target open face impact angles range between approximately 30 degrees to approximately 50 degrees.

9. The golf club head set of claim 3, wherein:

the first back face further comprises:

a second cavity located at the first heel region and comprising:
a second cavity base; and
a second cavity wall bounding at least a portion of the second cavity base; and
the second cavity wall comprises the heel hourglass sidewall of the first hourglass support.

10. The golf club head set of claim 9, wherein:
the second cavity base is devoid of a bar protruding therefrom.

11. The golf club head set of claim 3, wherein:
the toe hourglass sidewall of the first hourglass support comprises:
a top segment defining at least in part the top hourglass portion of the first hourglass support; and
the top segment is substantially parallel to the first bar axis.

12. The golf club head set of claim 3, wherein:
the toe hourglass sidewall of the first hourglass support comprises:
a bottom segment defining at least in part the bottom hourglass portion of the first hourglass support; and
the bottom segment is substantially perpendicular to the first bar axis.

13. The golf club head set of claim 3, wherein:
the toe hourglass sidewall of the first hourglass support comprises:
a top segment defining at least in part the top hourglass portion of the first hourglass support; and
a bottom segment defining at least in part the bottom hourglass portion of the first hourglass support;
and
an angle between the top and bottom segments is approximately 80 degrees to approximately 100 degrees.

14. The golf club head set of claim 3, wherein:
the toe hourglass sidewall is non-linear throughout the middle hourglass portion of the first hourglass support.

15. The golf club head set of claim 3, wherein:
the first club head comprises:
a first weight receptacle located only at the first toe region; and
a first toe weight located at the first weight receptacle and towards the first bottom end; and
the first toe weight comprises:
a first weight surface facing towards the first heel region; and
a first weight upper angle extended between the first vertical axis and the first weight surface.

16. The golf club head set of claim 15, further comprising:
a second club head comprising:
a second top end;
a second vertical axis;
a second toe weight comprising:
a second weight surface facing towards a second heel region of the second club head; and
a second weight upper angle extended between the second vertical axis and the second weight surface;
wherein:
a second loft angle of the second club head is greater than a first loft angle of the first club head;
at least the second club head comprises at least one of:
a wedge club head type; or
the second loft angle of at least approximately 42 degrees;
the first weight upper angle and the second weight upper angle are acute; and
the second weight upper angle is greater than the first weight upper angle.

17. The golf club head set of claim 3, wherein:
the top hourglass portion of the first hourglass support is at least one of wider or thicker than the bottom hourglass portion of the first hourglass support to raise a center of gravity of the first club head.

18. The golf club head set of claim 3, wherein:
the first bar of the first club head comprises at least one of:
a rectangular shape, or a triangular shape;
and
the first bar of the first club head comprises at least one of:
a solid pattern, a waffle pattern, a honeycomb pattern,
a dimpled pattern, a growth pattern or a reduction pattern.

19. The golf club head set of claim 3, wherein:
at least one of a first bar thickness or a first bar width of the first bar of the first club head increases towards the first top end of the first club head.

20. The golf club head set of claim 3, wherein:
the first back face of the first club head further comprises:
a second bar protruding from the first cavity base and parallel to the first bar.

21. The golf club head set of claim 20,
wherein:
the first bar comprises at least one of:
a first bar width greater than a second bar width of the second bar; or
a first bar thickness greater than a second bar thickness of the second bar;
and
the first bar is located closer to the first toe end than the second bar.

22. The golf club head set of claim 3, further comprising:
a second club head;
wherein:
the first club head further comprises a first toe weight located only at the first toe region and towards the first bottom end;
the second club head comprises a second vertical axis and a second bar;
the second bar comprises:
a second bar axis extended diagonally, relative to the second vertical axis, throughout a length centerline of the second bar; and
a second bar upper angle between the second vertical axis and the second bar axis;
the first back face further comprises:
a second cavity located at the first heel region and comprising:
a second cavity base devoid of a bar protruding therefrom; and
a second cavity wall bounding the second cavity base;
the second cavity wall comprises the heel hourglass sidewall of the first hourglass support;
the middle hourglass portion of the first hourglass support is located above a horizontal centerline of the first back face;
the top hourglass portion of the first hourglass support is at least one of wider or thicker than the bottom hourglass portion of the first hourglass support;
the first bar extends diagonally relative to the first vertical axis;
the first bar axis intersects with the first vertical axis and extends therefrom towards the first toe end and the first top end;
the first bar axis is angled at the first bar upper angle such that the first bar axis is substantially aligned with a strike path of the first club head when the first club head is at a target open face impact angle while proximate to a golf ball impact point along the strike path;

a second loft of the second club head is greater than a first loft of the first club head;

the second bar upper angle is greater than the first bar upper angle;

the toe hourglass sidewall of the first hourglass support comprises:

a top segment defining at least in part the top hourglass portion of the first hourglass support;

the top segment of the first hourglass support is substantially parallel to the first bar;

the toe hourglass sidewall of the first hourglass support is non-linear along the middle hourglass portion of the first hourglass support; and the first toe weight comprises a first weight surface facing towards the first heel region and substantially parallel to the first bar.

23. The golf club head set of claim 3, wherein:

the first back face comprises at least one of:

a first thickness of the first bar, the first thickness increasing towards the first top end of the first club head;

a first width of the first bar, the first width increasing towards the first top end of the first club head; or a second bar protruding from the first cavity base parallel to the first bar and closer to the first toe end than the first bar, the second bar being at least one of:

wider than the first bar; or thicker than the first bar.

24. The golf club head set of claim 3, further comprising:

a second club head comprising a second top end, a second vertical axis, and a second bar with a second bar axis;

wherein:

the second bar axis extends diagonally, relative to the second vertical axis, throughout a length centerline of the second bar;

the second bar comprises a second bar upper angle extended between the second vertical axis and the second bar axis;

the first bar comprises the first bar upper angle extended between the first vertical axis and the first bar axis;

a second loft angle of the second club head is greater than a first loft angle of the first club head;

at least the second club head comprises at least one of:

a wedge club head type; or the second loft angle of at least approximately 42 degrees;

the first bar upper angle and the second bar upper angle are acute; and the second bar upper angle is greater than the first bar upper angle.

25. A method for providing a golf club head set, the method comprising:

providing a first club head of one or more club heads comprising diagonal stabilizing bars;

wherein:

a first vertical axis extends through a first top end and a first bottom end of the first club head, and demarcates a first heel region from a first toe region of the first club head;

providing the first club head comprises:

providing a first back face opposite a first strike face of the first club head, the first vertical axis located approximately mid-way between a first toe end and a first heel end of the first club head, and extending substantially perpendicularly to a horizontal centerline of the first back face;

providing the first back face comprises:

providing a perimeter weight extending along at least the first top end and the first bottom end of the first club head;

providing a first hourglass support traversed by the first vertical axis and extended entirely from a top portion of the perimeter weight to a bottom portion of the perimeter weight;

providing a first cavity at the first back face and located only at the first toe region, the first cavity comprising a first cavity base and a first cavity wall bounding the first cavity base, the perimeter weight protruding above the first cavity base and defining one portion of the first cavity wall at the first toe region;

and providing a first bar within the first cavity, protruded from the first cavity base, and comprising:

a first bar axis extending along an entire length centerline of the first bar; and a first bar upper angle between the first vertical axis and the first bar axis;

the diagonal stabilizing bars of the one or more club heads comprise the first bar;

the first hourglass support protrudes from the first back face and comprises:

top and bottom hourglass portions;

a middle hourglass portion narrower than the top and bottom portions; and heel and toe hourglass sidewalls defining the top, middle, and bottom hourglass portions of the first hourglass support therebetween;

the toe hourglass sidewall of the first hourglass support protrudes above the first cavity base and defines another portion of the first cavity wall at the first toe region; and a minimum thickness of the first cavity wall protruded above the first cavity base is greater than a maximum thickness of the first bar protruded above the first cavity base.

26. The method of claim 25, further comprising:

providing a second club head of the one or more club heads;

wherein:

providing the second club head comprises:

providing a second back face and a second top end of the second club head;

providing a second cavity at the second back face and at a second toe region thereof;

providing a second bar within and protruded from the second cavity and aligned diagonally at a second bar upper angle relative to a second vertical axis of the second club head, the diagonal stabilizing bars of the one or more club heads comprising the second bar;

providing a second loft angle of the second club head to be greater than a first loft angle of the first club head; and providing the second bar upper angle to be greater than the first bar upper angle;

and providing the first hourglass support comprises:

providing a top segment of the toe hourglass sidewall to be substantially parallel to the first bar axis; and providing the toe hourglass sidewall to be non-linear along the middle hourglass portion of the first back-side support.

27. The method of claim 26, wherein:

providing the first club head comprises:

providing a first toe weight located at the first back face, at the first toe region, and towards the first bottom end;

providing the second club head comprises:

providing a second toe weight located at the second back face and at the second toe region of the second club head;

providing the first toe weight comprises:

providing a first weight surface of the first toe weight facing towards the first heel region of the first club head at a first weight upper angle relative to the first vertical axis;

and providing the second toe weight comprises:

providing a second weight surface of the second toe weight facing towards a second heel region of the second club head at a second weight upper angle relative to the second vertical axis; and providing the second weight upper angle to be greater than the first weight upper angle.

28. The method of claim 25, wherein:

providing the first club head further comprises at least one of:

providing at least one of a first bar thickness or a first bar width of the first bar to increase towards the first top end of the first club head; or providing a second bar protruding from the first cavity base and substantially parallel to the first bar, the second bar being located closer to the first toe end than the first bar, and comprising at least one of:

a second bar width greater than the first bar width of the first bar; or a second bar thickness greater than the first bar thickness of the first bar.

29. The method of claim 25, further comprising:

providing a second club head comprising a second top end, a second vertical axis, and a second bar with a second bar axis;

wherein:

the second bar axis extends diagonally, relative to the second vertical axis, throughout a length centerline of the second bar;

the second bar comprises a second bar upper angle extended between the second vertical axis and the second bar axis;

the first bar comprises the first bar upper angle extended between the first vertical axis and the first bar axis;

a second loft angle of the second club head is greater than a first loft angle of the first club head;

at least the second club head comprises at least one of:

a wedge club head type; or the second loft angle of at least approximately 42 degrees;

the first bar upper angle and the second bar upper angle are acute; and the second bar upper angle is greater than the first bar upper angle.

* * * * *